US007171994B1

(12) United States Patent
O'Brien

(10) Patent No.: US 7,171,994 B1
(45) Date of Patent: Feb. 6, 2007

(54) SPILLAGE CONTAINMENT SYSTEM AND KIT FOR UNDERGROUND STORAGE TANKS

(76) Inventor: Patrick E. O'Brien, 16653 Caledonia Rd., Caledonia, IL (US) 61011

( * ) Notice: Subject to any disclaimer, the term of this patent is extended or adjusted under 35 U.S.C. 154(b) by 0 days.

(21) Appl. No.: 11/237,290

(22) Filed: Sep. 28, 2005

(51) Int. Cl.
*B65B 1/04* (2006.01)

(52) U.S. Cl. ..... 141/311 A; 141/86; 405/52; 404/25; 52/20

(58) Field of Classification Search ..... 141/311 A, 141/86, 98; 52/20; 404/25; 405/52; 137/312
See application file for complete search history.

(56) References Cited

U.S. PATENT DOCUMENTS

| | | | |
|---|---|---|---|
| 4,501,305 | A | 2/1985 | Zola et al. |
| 4,527,708 | A | 7/1985 | Dundas et al. |
| 4,579,155 | A | 4/1986 | Zola |
| 4,615,362 | A | 10/1986 | Hartman et al. |
| 4,655,361 | A | 4/1987 | Clover et al. |
| 4,685,585 | A | 8/1987 | Robbins |
| 4,706,718 | A | 11/1987 | Milo |
| 4,717,036 | A | 1/1988 | Dundas et al. |
| 4,762,440 | A | 8/1988 | Argandona |
| 4,770,317 | A | 9/1988 | Podgers et al. |
| 4,793,387 | A | 12/1988 | LeBlanc et al. |
| 4,871,084 | A | 10/1989 | Robbins |
| 4,958,957 | A | 9/1990 | Berg et al. |
| 4,999,900 | A | 3/1991 | Anderson |
| 5,058,633 | A | 10/1991 | Sharp |
| 5,098,221 | A | 3/1992 | Osborne |
| 5,114,271 | A | 5/1992 | Sunderhaus et al. |
| 5,222,832 | A | 6/1993 | Sunderhaus et al. |
| 5,271,052 | A | 12/1993 | Impink, Jr. et al. |
| 5,363,093 | A | 11/1994 | Williams et al. |
| 5,372,453 | A | 12/1994 | Argandona |
| 5,544,974 | A | 8/1996 | Berg et al. |
| 5,595,088 | A | 1/1997 | Horner |
| 5,595,456 | A | 1/1997 | Berg et al. |
| 5,882,045 | A | 3/1999 | Bravo |
| 5,944,361 | A | 8/1999 | Bravo |
| 5,975,132 | A | 11/1999 | Gleeson |
| 6,374,187 | B1 | 4/2002 | Knight et al. |
| 6,655,418 | B1 | 12/2003 | McGill et al. |
| 6,840,293 | B1 | 1/2005 | Smith |
| 2004/0200842 | A1 | 10/2004 | Low et al. |
| 2004/0234338 | A1 | 11/2004 | Monroe et al. |

*Primary Examiner*—Steven O. Douglas
(74) *Attorney, Agent, or Firm*—Meroni & Meroni, P.C.; Charles F. Meroni, Jr.; Christopher J. Scott

(57) ABSTRACT

A matter-isolating system for use in combination with an underground storage tank assembly comprises primary and secondary spillage containment assemblies and a double-walled manhole assembly. The manhole assembly comprises a manhole lid, an outer skirt wall, and an inner skirt wall. The inner skirt wall defines an inner manhole cavity and an outer manhole channel. The outer manhole channel directs moisture from the lid to certain backfill material thus isolating the inner manhole cavity from channel-directed moisture. The spillage containment assemblies form concentric primary and secondary spillage-containing chambers in radial adjacency to a tank access conduit of the underground tank assembly. The inner manhole cavity functions to isolate the secondary spillage containment chamber from the outer manhole channel and the primary spillage containment chamber isolates the secondary spillage containment chamber from the tank access conduit. A chamber-monitoring system may be incorporated into the system for monitoring the isolated chambers.

41 Claims, 17 Drawing Sheets

-75-
-81-
-56-
-80-
-74-
-75-

-74-

SPILLAGE CONTAINMENT SYSTEM AND KIT FOR UNDERGROUND STORAGE TANKS

BACKGROUND OF THE INVENTION

1. Field of the Invention

The present invention generally relates to a matter containment system for use in combination with an underground storage tank. More particularly, the present invention relates to a secondary spillage containment system or kit for outfitting an underground storage tank assembly having primary spillage containment.

2. Description of the Prior Art

Those experienced with underground storage tanks and the maintenance thereof must often address the fact that many of the underground storage tanks suffer from aged, deteriorated, and contaminated fill locations. The effects of petroleum products entering, and contaminating ground water from spills, and leaks is well documented and there is a great deal of documentation detailing the negative effects of contaminated ground water. Obviously, if a leak or spill can be prevented the environment will benefit. In an effort to protect the environment from leaks and spills of the type here noted the United States Congress enacted the Underground Storage Compliance At of 2003. The Act attempts to regulate the use of underground storage tanks and thus attempts to foster improvements to underground storage tank systems to minimize spillage and soil contamination.

In addition to federal law(s), many local and state laws have also been written to regulate the use of underground storage tank systems. Often, however, the conditions surrounding the underground storage tanks are in violation of any number of local, state, and/or federal laws. In this regard, it is noted that all current fill locations at underground storage tanks must have an overspill (OS) device capable of holding at least 5 gallons of liquid. This device is practical and is used for a collection vessel upon the draining hoses after a fill delivery is made. The OS device has a small opening at the top of the device approximately 9 to 10 inches in diameter, which opening allows access to the fill riser pipe that is connected to the tank top and is used as the port for liquid delivery. The existing overspill or OS devices are designed to be water tight at installation and most contain a drain port allowing drainage of the device through said port to the fill riser pipe. The overspill device is typically accessible by opening a manhole lid at the grade of the concrete drive and is designed to act as a spill catch for fuel delivery drivers draining the delivery hose from the delivery truck after dropping/delivering a load of product. This mandatory OS device has proven effective and has contained a great deal of spillage, there being on the order of 700,000 active underground storage tanks in the United States.

As time has gone by many of the OS devices have started to show wear and attendant contamination. Indeed, it is rare to find a fill location that has no contamination present. Existing OS devices thus, do not come close to offering a complete solution to the spillage, leakage, and contamination problems that still exist at underground storage tanks. A number of means for secondarily containing spillage adjacent underground storage tanks has arisen. Indeed, all underground storage tank components (including tanks, product piping, dispensers, and pumps) of the underground tank system that hold, or transfer liquids must also be secondarily contained (except for the most spill prone, used, overlooked, component the OS location, namely, the fill port).

The underground storage tank assembly typically has an outer containment tank with monitoring capability as achieved by a sensor installed at the interstitial space between the walls of said tank. The pumping devices are located on the top of the underground storage tank and have a secondary containment sump that acts as a collection device for liquids in case of a leak. The sump is also usually monitored by a sensor. The piping from the pump/suction device at the tank top sump is secondarily contained by the primary piping being surrounded by a larger diameter pipe from the tank top sump to the dispensing location. The dispensing location (pump or dispenser) also typically has a sump located beneath the dispensing device. The dispenser/pump sump is monitored via a sensor. All of the major components that contain and hold fuel at an underground storage tank system are thus secondarily contained and have the capability of being monitored at the tank monitoring systems. Almost all underground storage tank systems have a tank monitoring system that, when in alarm status, will give an audible warning and a print out of the alarm condition.

Perhaps the most used, spill prone, and volatile point of an underground storage tank is the fill port. It then follows that the most used, spill prone, and volatile port of the underground storage tank system should be secondarily contained. As earlier noted, there are approximately 700,000 active underground storage tanks in the United States, and the amount of spillage at and around the existing OS locations of these 700,000 underground storage tanks on a daily basis is often not reported and/or cleaned. It then follows that a great deal of petroleum product enters and contaminates groundwater supplies. Clearly secondary containment of the fill port location of underground storage tanks is useful, if not essential.

Current methods of containing spillage at the fill location of underground storage tanks by an overspill device are lacking in certain respects. The most notable problems may be listed, as follows: 1) a relatively small 9–10 inch opening at the top of the OS device (the small opening does not allow much room for delivery error or missed spillage. 2) Upon completion of installation of an OS device, and after a period of time, a build up of debris/silt forms a dam between the skirt material of the manhole and the OS device allowing water infiltration and build up of debris/silt surrounding the OS device. 3) The water/silt build up also damages the lid assembly and components of the OS device (making the initial water tight capability obsolete, and thus allowing debris, silt, or water to infiltrate the OS device, thus damaging the drain device of the OS device, and thus the probability of the water, silt, and debris infiltrating the UG storage tank. 4) The area outside of the OS device is a release point to the environment (soil, groundwater). When a spill occurs outside of the small opening at the OS device the spill is a release into the environment. Spillage of even the smallest amounts will build up over the lifetime of the underground storage tank system and will create certain far-reaching environmental problems. 5) Most currently used OS devices do not have means for containing, monitoring, or receiving notification of spillage or water infiltration with the use of the OS device. 6) When liquid spillage occurs outside of the OS device, the tank owner is held liable, and in most cases will not otherwise be advised of the spillage.

It is noted that while the prior art attempting to address secondary containment of underground fill/overfill area is somewhat well-developed, it is further noted that the most spill-prone area of the underground storage tank system (namely, the fill, overspill area) frequently does not benefit from secondary containment for various reasons. The prior art thus perceives a need for a secondary containment system, easily installable and effective to prevent misdirected, otherwise uncontained spillage adjacent typical underground storage tank systems. A listing of certain relatively ineffective prior art specifically relating to secondary spillage containment systems and the like, is briefly described, hereinafter.

U.S. Pat. No. 4,655,361 ('361 patent), which issued to Clover et al., discloses a Containment Tank. The '361 patent teaches a secondary containment tank and manhole cover assembly. The assembly provides access to a fill pipe for a main underground storage tank and prevent overflow of excess volatile liquid such as gasoline into the ground. The containment tank includes an upper ring or rim secured on an in-ground vertical skirt supported in a concrete base. An inner container is secured to the vertical skirt and has an open end adjacent to the upper ring. The cover fits into and is supported on a horizontal flange or step of the upper ring over the opening of the inner container and includes a vertical ring extending downwardly from the underside of the cover into a space between the inner container and vertical skirt. The vertical ring on the cover extends below the level of the container opening and thus bypasses any surface water leakage through the upper ring around the cover into the space adjacent to the container and into the ground below. The upper containment tank also includes means such as a manually operable sump pump or drain valve to empty excess liquid into the fill pipe of the main storage tank.

U.S. Pat. No. 4,706,718 ('718 patent), which issued to Milo, discloses a Containment Manhole having Spillage Sealing Means. The '718 patent teaches a containment manhole comprising a hollow body having a closed bottom and an open top. A concentric opening is provided in the bottom to receive an underground tank fill therethrough and a circular, resilient seal is provided to seal the junction between the tank fill and the manhole bottom. Optionally, a drain valve may be provided in the manhole bottom to lead any spillage directly back to the tank fill. The manhole terminates upwardly in the machined ring and includes a gasketed junction with the ring. The ring includes an upper shoulder upon which the cover peripheral lip can rest and a lower shoulder of size to enable the cover peripheral edges to rest. An O-ring seal is provided intermediate the cover and the top ring to provide a first sealed junction and a circular gasket is affixed on the lower ring edge to provide a second seal when the cover is in position.

U.S. Pat. No. 4,717,036 ('036 patent), which issued to Dundas et al., discloses a Liquid Tank Spillage Control System. The '036 patent teaches a spill control device for underground liquid storage tanks having an upwardly extending fill pipe. The control device comprises a steel, epoxy coated, and liquid collecting spill tank having a riser tube that extends upward through the tank bottom. A circular seal ring fits about the upper end of the riser tube and about the outer wall of a fill pipe received through the riser tube. A clamp compresses the seal about both the riser tube and fill pipe. A liquid impermeable cover is provided which covers the access opening in the top of the spill tank. A first basin surrounds the cover for channeling precipitation, and other liquids impinging the cover, away from the spill tank. A valve is disposed on the fill pipe for selectively directing liquids discharged into the spill tank into the storage tank. A second basin surrounds the spill tank for recovering liquids discharged from the spill tank during a filling operation.

U.S. Pat. No. 4,762,440 ('440 patent) and U.S. Pat. No. 4,842,443 ('443 patent), both of which issued to Argandona, disclose certain Spill Containment Device(s). The '440 and '443 patents teach spill containment devices for the fill tube of a liquid storage tank, particularly an underground, liquid storage tank. The containment devices each have a spill container with a bottom opening for receiving the tank fill tube in liquid sealing relation to the container wall and a top opening through which the fill tube is accessible for filling the tank, whereby the container contains any liquid spill during filling of the tank. The container top openings are closed by removable covers which cooperate with a water drain arrangement to vent liquid vapor from the containers while preventing rain and other ground surface water from entering the containers. A drain valve operable from a position adjacent each container top opening is provided for draining liquid spill from the respective container to the tank. One embodiment is designed to receive multiple tank fill tubes and has a surrounding casing with a relatively massive top end closure having openings closed by separate relatively small covers which are individually removable to access the different tank fill tubes.

U.S. Pat. No. 5,058,633 ('633 patent), which issued to Sharp, discloses a Containment Assembly for Fill Pipe of Underground Storage Tanks. The '633 patent teaches an assembly intended for use on underground storage tanks. The assembly provides ready access to a fill pipe from ground level. At the same time the assembly serves as a spill containment means for accidental spillage and a secondary containment means for the fill pipe. The assembly of the invention comprises a secondary containment chamber having a sidewall with means for attaching to the storage tank. An anchor ring which is attached to an upper open end of the containment chamber acts as a permanent ground base for the assembly. A bridging surface cover within the anchor ring has a removable lid positioned in its interior portion to gain access to the chamber's interior for a filling operation. The assembly also comprises a fill pipe for delivering liquid to the storage tank. The fill pipe is positioned within the secondary containment chamber with a discharging end extending through the chamber's bottom and a receiving end terminating within the chamber but near the bridging surface cover. An open top spill compartment is positioned within the secondary containment chamber and at the receiving end of the fill pipe so as to encompass the fill pipe's receiving end for the purpose of catching any spilled liquid from the filling operation. The spill compartment also prevents any of the spilled liquid and vapors from entering the secondary containment chamber.

U.S. Pat. No. 5,222,832 ('832 patent), which issued to Sunderhaus et al., discloses Spill Containment Devices and Their Installation. The '832 patent teaches a below grade, spill containment device for connection with the riser pipe of an underground fuel storage tank. The containment device is disposed within and isolated from a manhole, which is mounted in a concrete apron. The containment device comprises a compositely formed container, rigidly mounted on the riser pipe. The container formed of structural synthetic resin material elements held in assembled relation by snap fitted lugs and notches. A lid, for closing the upper, access opening, is mounted on a pivotable arm. A lever pivoted on the arm selectively engages latch means to lock the lid in a closed position. A projection on the lever prevents the manhole cover from seating if the lever is not in its lock position. A valve for draining fuel from the container to the riser pipe is closed when the lid is open and opened when the lid is closed. The manhole and the containment device are packaged in a shipping carton in spaced relation be corrugated paper sheets. These sheets are employed in obtaining a desired relation between the containment device and manhole in the installation of these components, which involve pouring a concrete apron around the upper end of the manhole. An alternative system employs adjusting nuts to obtain this relationship between the manhole and containment device. In one embodiment the manhole is compositely formed to permit relative movement between its upper and lower portions, after installation.

U.S. Pat. No. 6,655,418 ('418 patent), which issued to McGill et al., discloses a Drop Tube Seal for Petroleum Underground Storage Tanks. The '418 patent teaches a drop tube sealing assembly. The assembly may contain a riser pipe having a proximal end with internal threads and an underground storage tank spaced apart from the proximate end of the riser pipe. The storage tank may contain a threaded inlet which is positioned atop the tank. A pipe nipple may include a first end in cooperation with the proximal end, an opposite end in cooperation with the threaded inlet, and an annular inner surface that forms a conduit. The inner surface may comprise a female thread section. A drop tube adapter fitting may be concentrically disposed within the pipe nipple. The adapter fitting may contain an outer surface containing external threads in cooperation with the female thread section. A seal in the form of an O-ring may be disposed between the adapter fitting and the pipe nipple. A drop tube having an open end may be coupled to the adapter fitting.

It will be seen from a further review of the above-referenced patents and other prior art generally known to exist relating to underground storage tank spillage containment systems, that the prior art does not teach a secondary spillage containment system comprising a double-walled manhole skirt assembly in combination with a secondary spillage containment assembly as concentrically situated about primary spillage containment and tank-accessing means. Further, the prior art does not teach a matter isolation kit installable upon an underground storage tank assembly comprising a tank access conduit (peripherally encased by primary spillage containment) for secondarily containing spillage, for sealing the secondary containment, and for isolating the various containment or isolating structures from foreign matter coming into contact with the outfitted underground storage tank assembly. The prior art thus perceives a need for a matter isolation system and kit comprising a double-walled manhole skirt assembly in combination with a secondary spillage containment assembly installable in radial adjacency to the longitudinal axis of certain primary spillage containment and tank-accessing means, which system and kit function to secondarily contain spillage, selectively seal secondary containment from outside influence, and isolate the primary and secondary containment systems from foreign matter coming into contact with an outfitted underground storage tank assembly.

SUMMARY OF THE INVENTION

Accordingly, it is an object of the present invention to provide a secondary spillage containment system and kit, which when outfitted upon an underground storage tank assembly functions to isolate matter commonly associated with underground storage tank systems. The present invention thus attempts to address the problems previously noted regarding state of the art overspill containment systems, including lengthy delays or oversight in being advised of a spillage problem. It is noted that the liability of a spill remains with the tank owner. With the present invention, the tank owner is made aware of a spill immediately by notification (alarm at TMS/Pod detector) and the spill will be contained in a secondary spillage containment chamber until it is removed (the spill must be removed/cleaned to reset the sensor).

Further objects of the present invention are to address the above-listed shortcomings of the prior art, as follows: 1) The access opening of the secondary spillage containment system (Spillpod) will be at least twice the size of current OS device openings, allowing a larger collection point of spillage. 2) The design features of the Spillpod kit (water elimination drain system, and debris collection trays) will eliminate the potential of water, silt, and debris from accumulating around the Spillpod, thus the interior of the Spillpod will be clean and debris free, which serves to protect or isolate the OS device inside of the Spillpod, which will also be clean, functional, and debris free. 3) The area in outside adjacency to the OS will be a secondary containment device (SP) capable of catching and containing any spillage that should occur. 4) The area intermediate the SP and an isolation wall can be closed using a wedge/ring. Optionally, the noted area may also be open to allow water to drain, yet still collect any hazardous liquids with a liquid/debris/absorbent sock tray. The tray may hold an absorbing material (sock) that will not hold water, but will hold hazardous liquids. The area between the SP and the isolation wall will allow movement of the underground storage tank, or concrete slab that may occur over time due to settling without stress being applied to the SP (the SP will be connected to the tank, but not connected to the concrete slab).

The area between the SP and the isolation wall or riser will be minimal and will have means to collect any spillage/debris that may collect outside of the SP. 5) Notification via a sensor installed inside of the SP will allow instant notification of spillage or water infiltration. 6) When spillage occurs the tank owner is still liable, but the spill is contained, and the owner immediately notified of the spillage.

Spillage, mistakes, and accidents will always be a part of the everyday life of the fill location. With notification via the sensor assemblage of the presently disclosed inventive system, the spillage may then be promptly cleaned, and removed to clear the alarm status at the TMS or Pod detector. With the use of the SP kit the spillage, water, silt, and debris problems that otherwise occur at the OS location are eliminated. The release of hazardous liquids into the environment is also eliminated. The owner of the tanks further receives prompt notification (an automatic print out from the TMS) of when, where and why a problem at the fill location occurred.

To achieve these and similar other readily ascertainable objectives, the present invention provides a secondary spillage containment kit that will secondarily contain an existing overspill containment device, and comprise certain means for receiving certain chamber-monitoring sensors. The kit also includes a new type of manhole assembly with water/silt elimination means and an add-on or secondary manhole assembly for housing/protecting certain electrical connection(s) of the chamber-monitoring system externally to the secondary spillage containment (chamber). The secondary spillage containment system of the present invention, nicknamed "Spillpod," has new design features that will address problems that exist at current underground storage tank fill locations. The Spillpod will allow the immediate notification of a problem (spillage, water entrance, via sensors located in select chambers, which sensors are in communication with a remotely-located tank monitoring system or Pod Detector (inside of the primary building TMS, or the exterior of the building with an externally mounted Spillpod detector) at the underground storage tank fill location.

Essentially, the Spillpod system is a matter-isolation system for use in combination with an underground tank assembly having a storage tank and a tank access conduit. The matter-isolation system comprises a first spillage containment assembly comprising a first basal platform, a containment wall, and first conduit-accessing means. The containment wall comprises a superior end, an inferior end, an inner surface, and an outer surface. The first basal platform comprises first conduit-engaging means and certain pod-support structure. The first conduit-engaging means are cooperatively communicated with the tank access conduit and the inner surface is positioned in substantially concentric relation about the tank access conduit. The containment-accessing means and the first conduit-engaging means together function to enable the user to selectively access the tank access conduit via the superior end. The inner surface, the pod-support structure, and the first conduit-accessing means form a first spillage containment chamber adjacent the tank access conduit for containing spillage.

The matter-isolation assembly is also for use in combination with a manhole and thus comprises a double-walled, lid-supporting skirt assembly comprising an outer isolation wall, an inner isolation wall, a superior skirt end, and an inferior skirt end, the inner isolation wall essentially defines an inner manhole channel and an outer manhole channel. The outer manhole channel extends intermediate the inner isolation wall and the outer isolation wall. The inner isolation wall supports a manhole lid in superior adjacency to the manhole. The outer manhole channel directs moisture from the superior lid surface to the inferior skirt end and isolates the inner manhole channel from channel-directed moisture.

It is noted that certain regulations should perhaps be adopted making it mandatory for secondary containment at the fill port location of underground storage tanks, the most spill prone area of an underground storage tank. Underground storage tank owners and oil companies surely want to protect their investment in the underground storage tank systems and further desire to protect the environment. The present invention addresses protection, notification, and problem solving aspects that are sorely needed at the fill port location of underground storage tanks.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of certain brief description(s) of my patent drawings, as follows:

FIG. No. 1 is a fragmentary side view depiction of a preferred secondary spillage containment system of the present invention in communication with a first underground storage tank assembly with certain parts broken away to show inner, otherwise-hidden structure.

Figure 1:
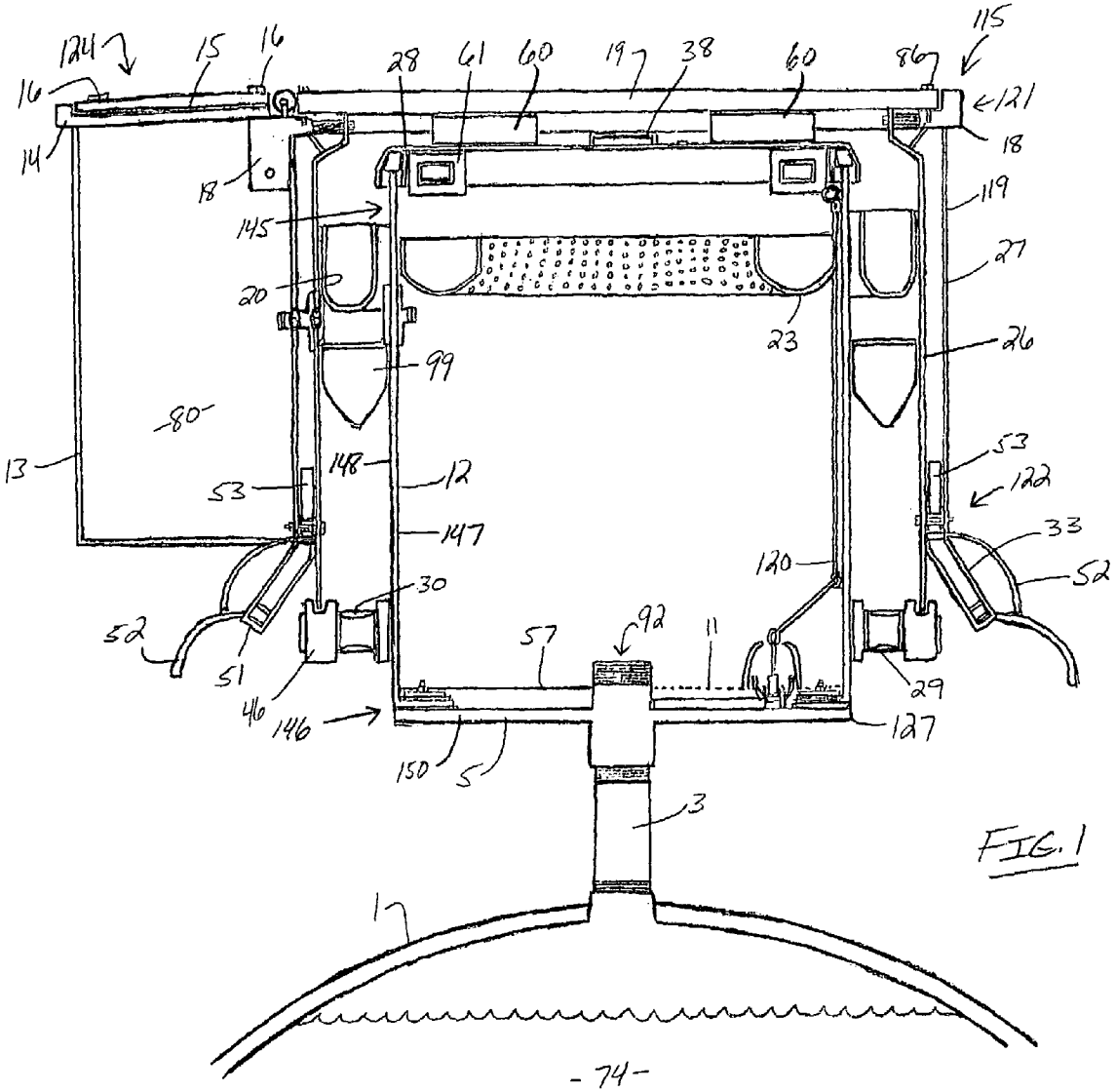
Figure 2:
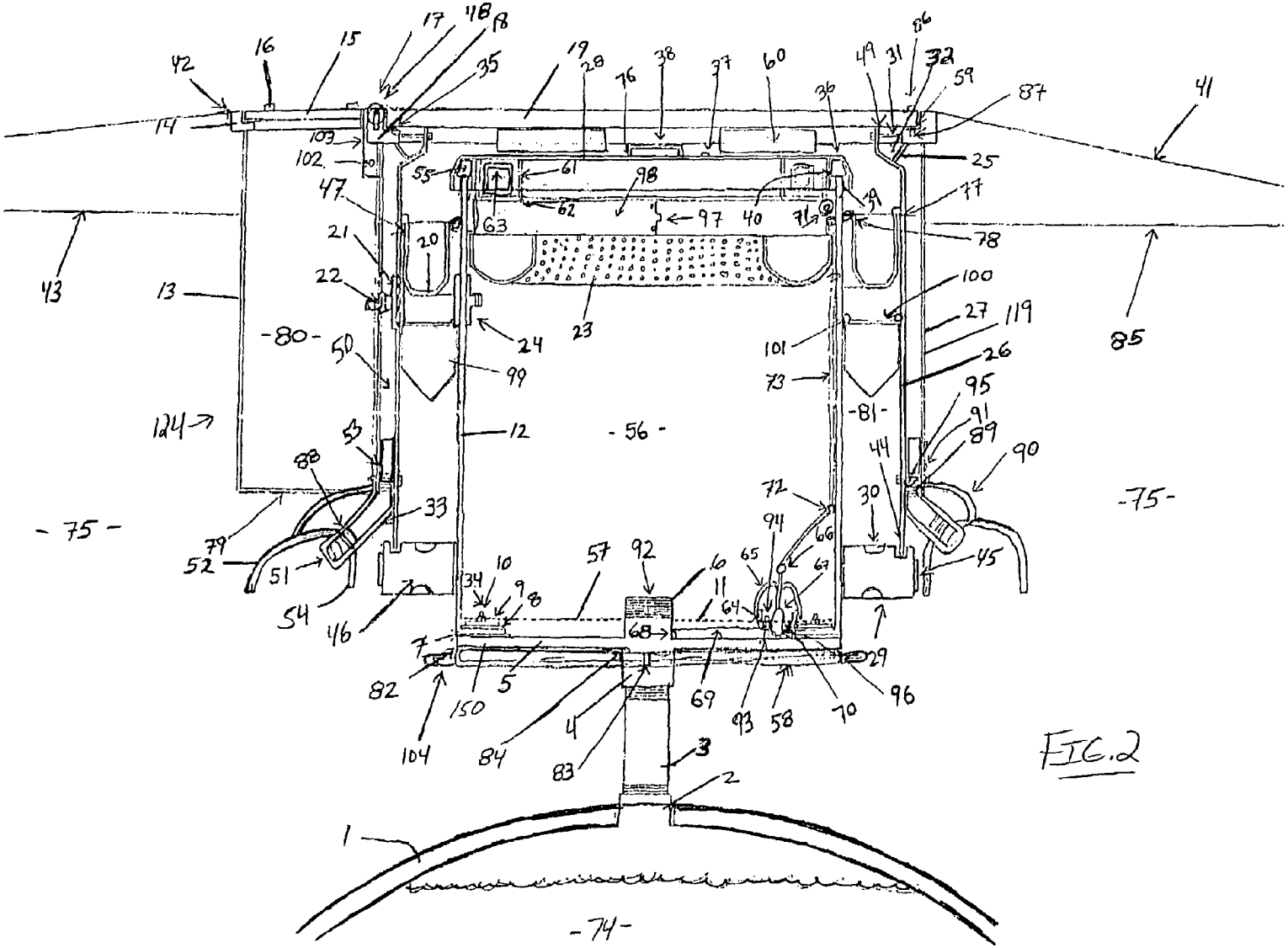
Figure 3:
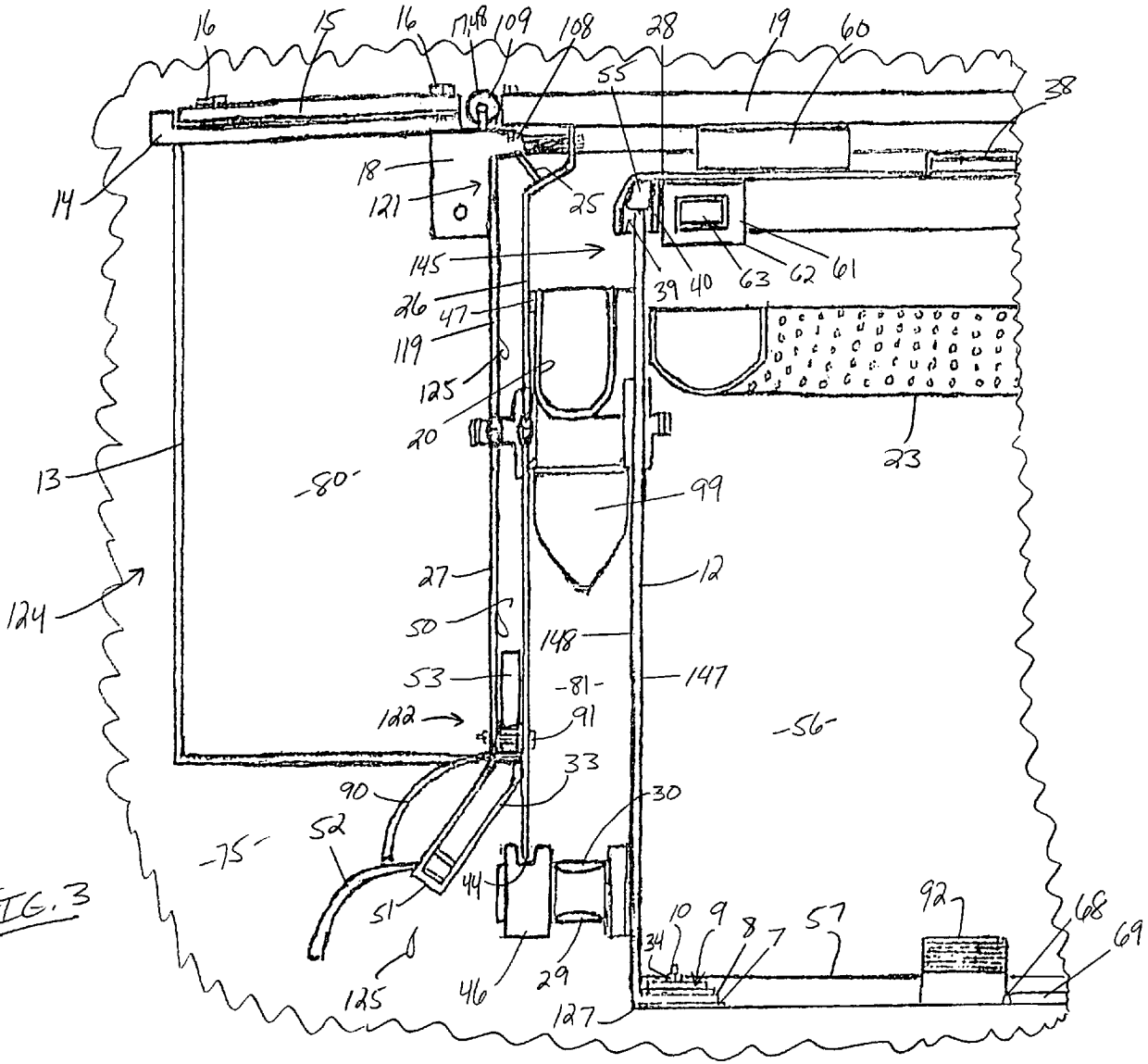
Figure 4:
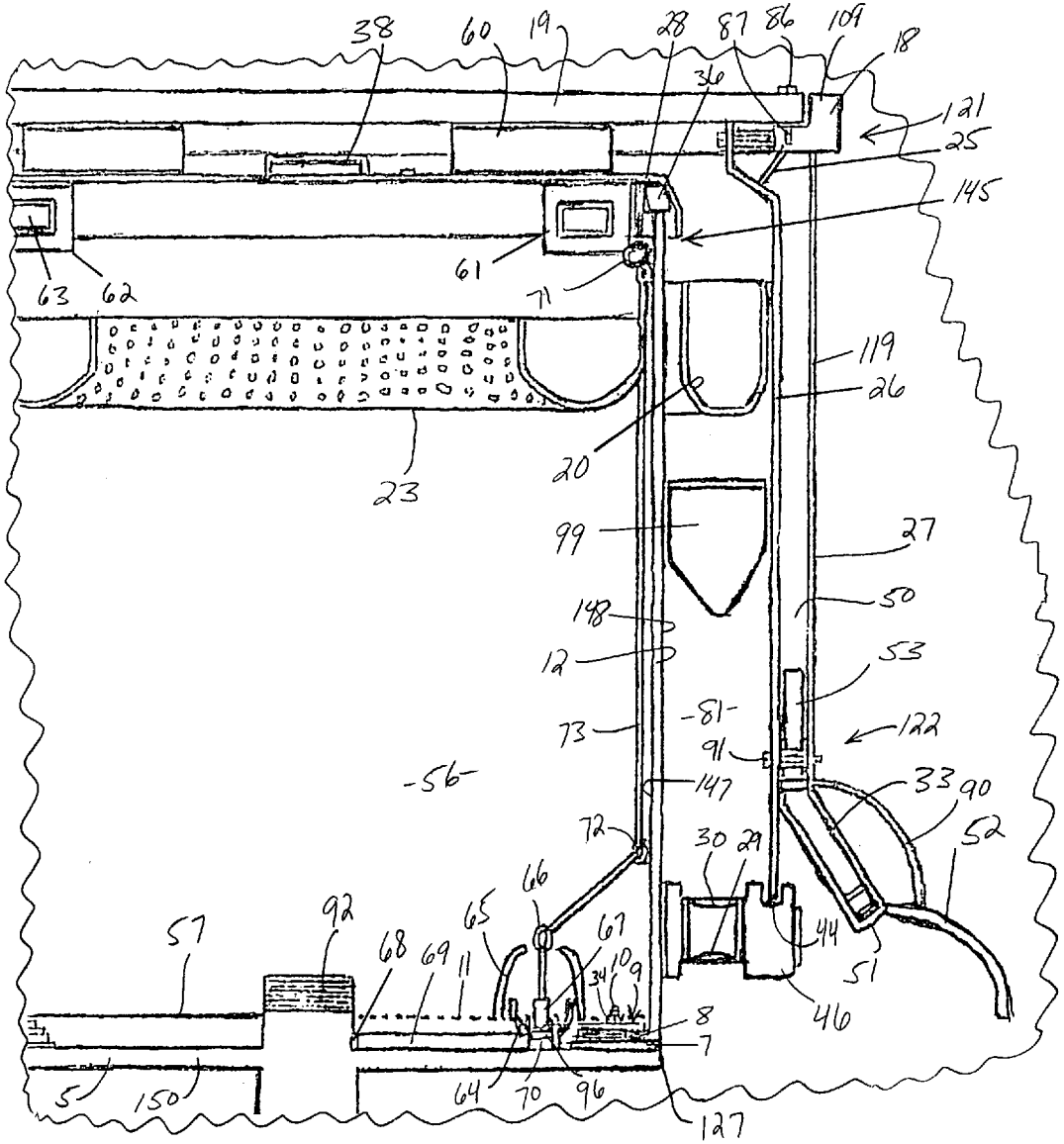
Figure 5:
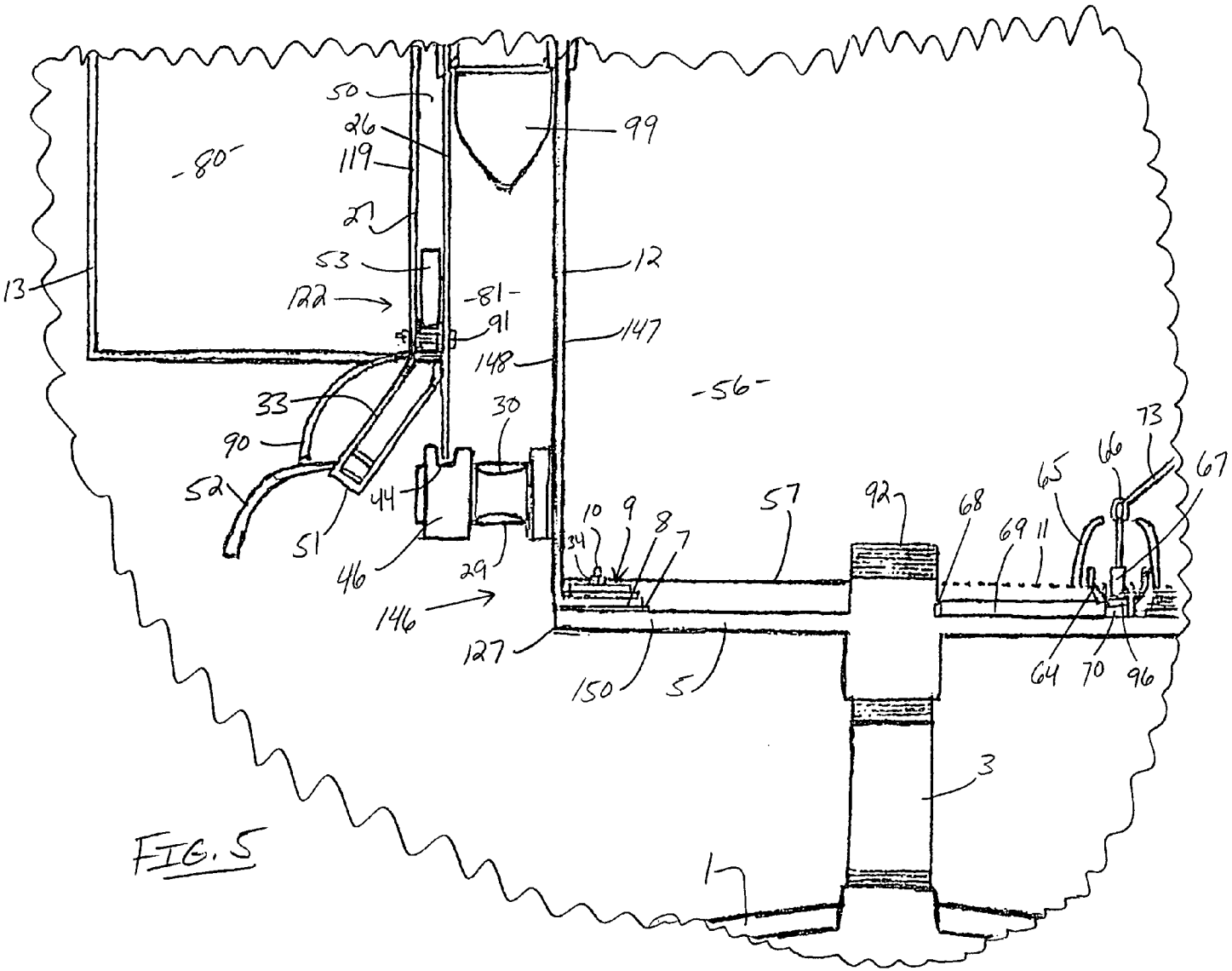
Figure 6:
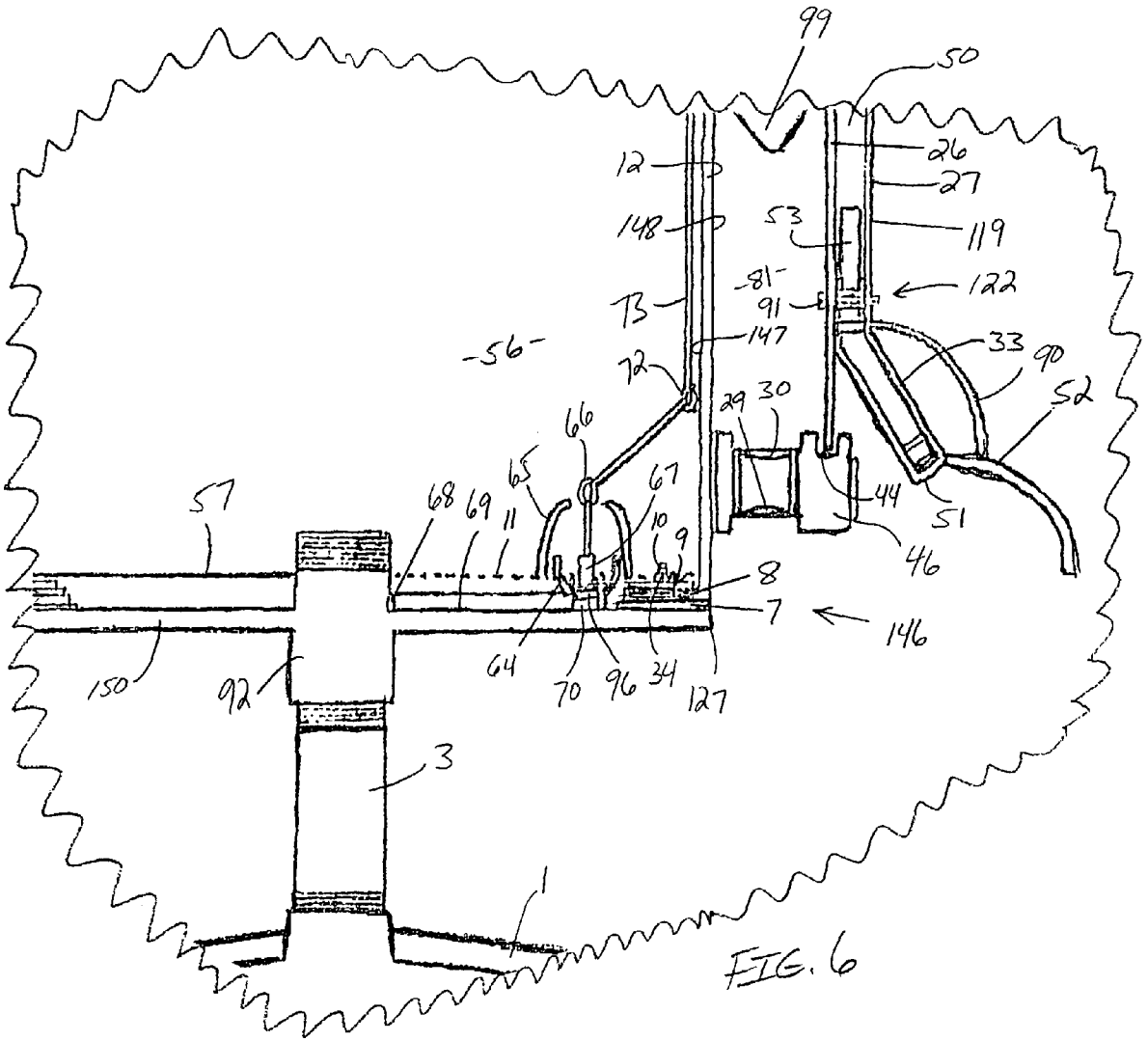
Figure 7:
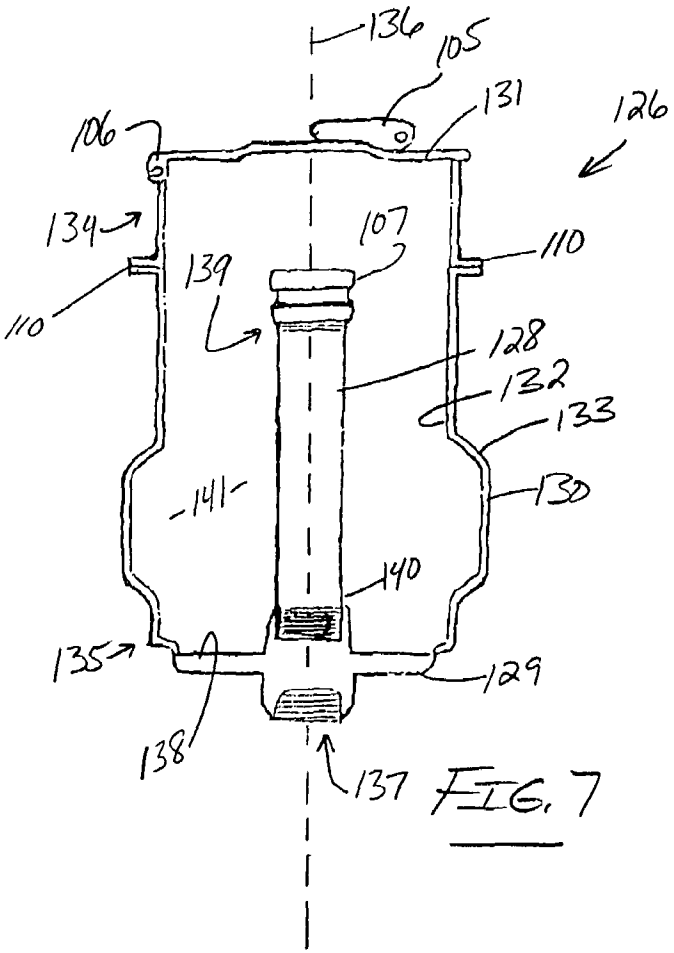
Figure 8:
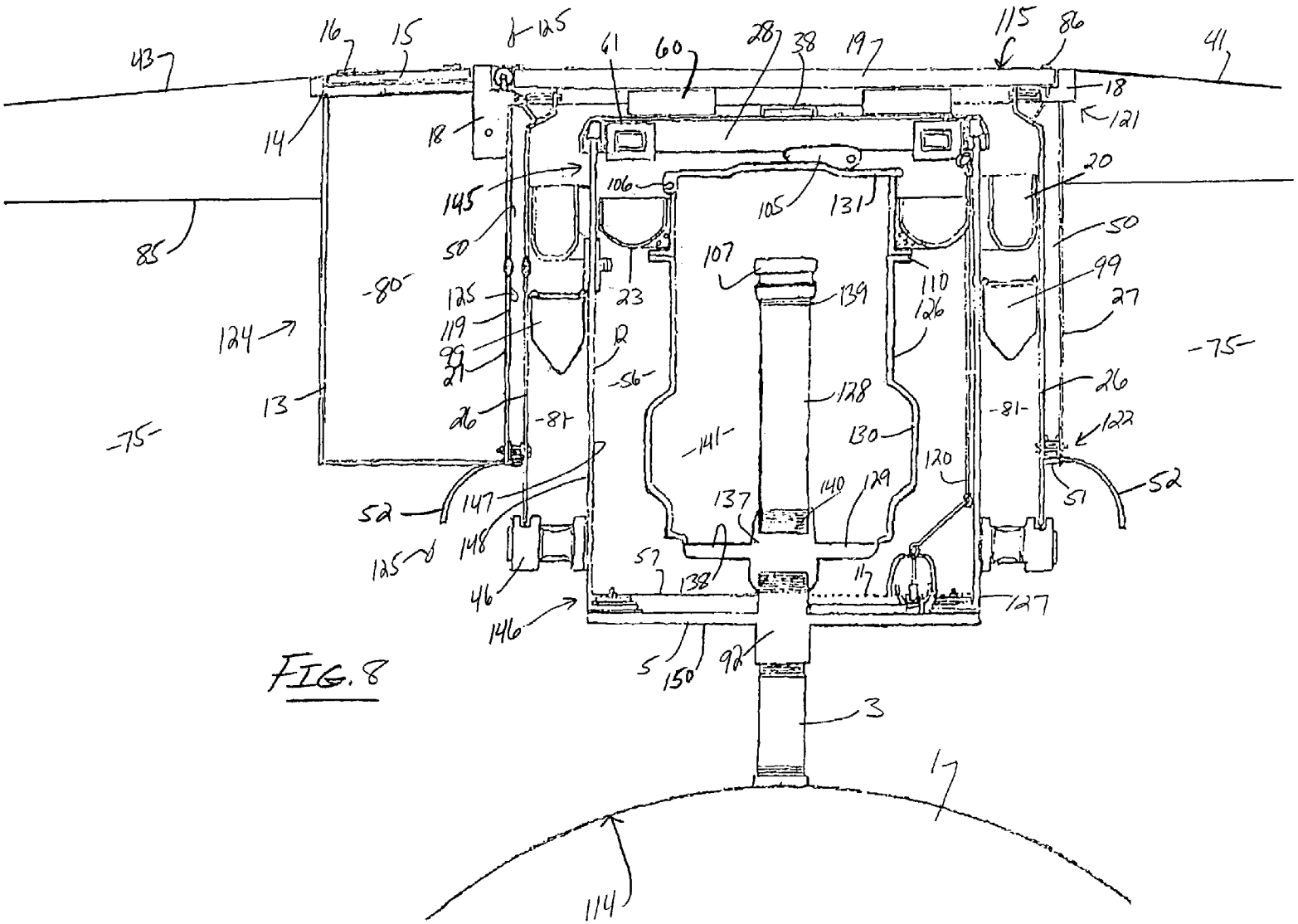
Figure 9:
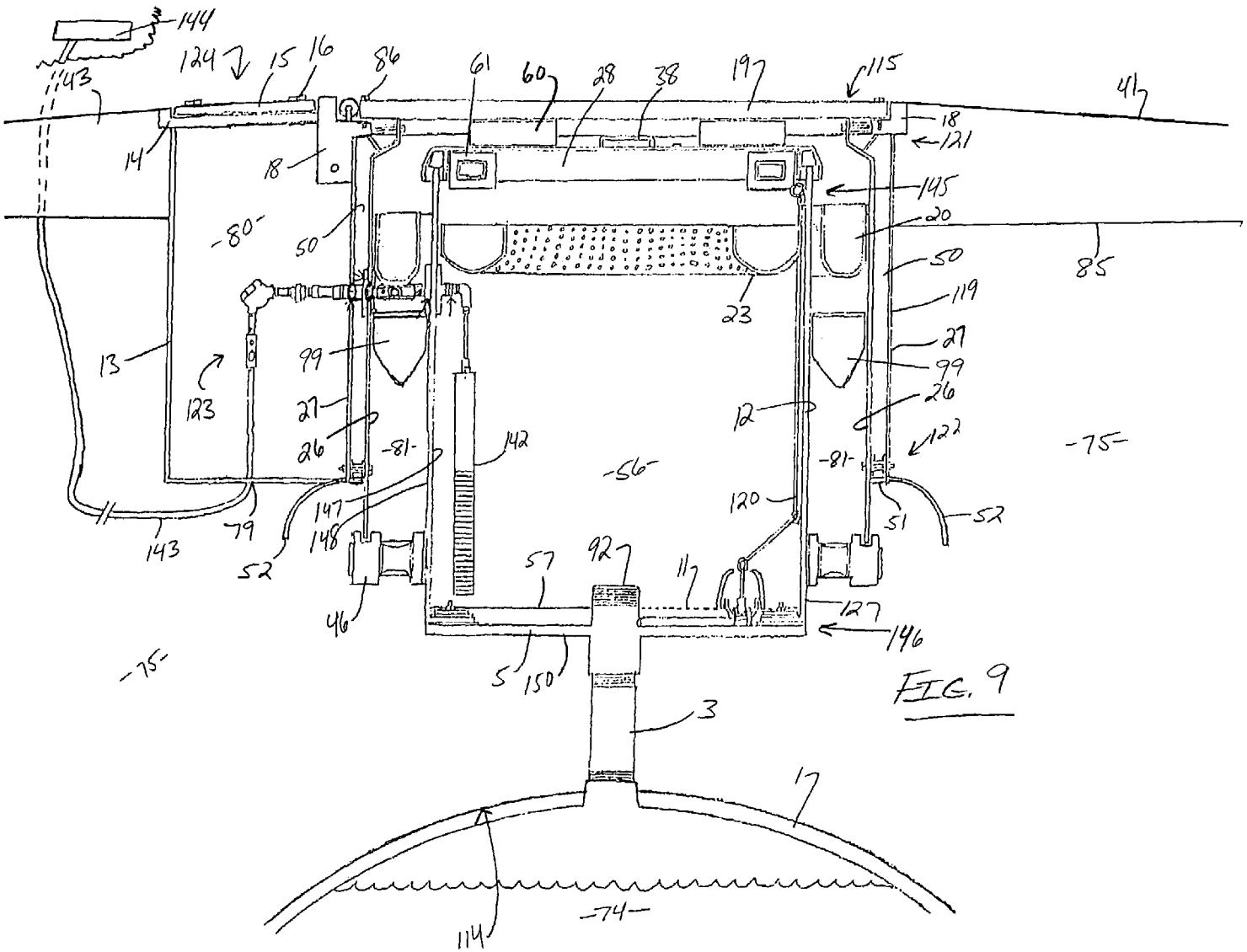
Figure 10:
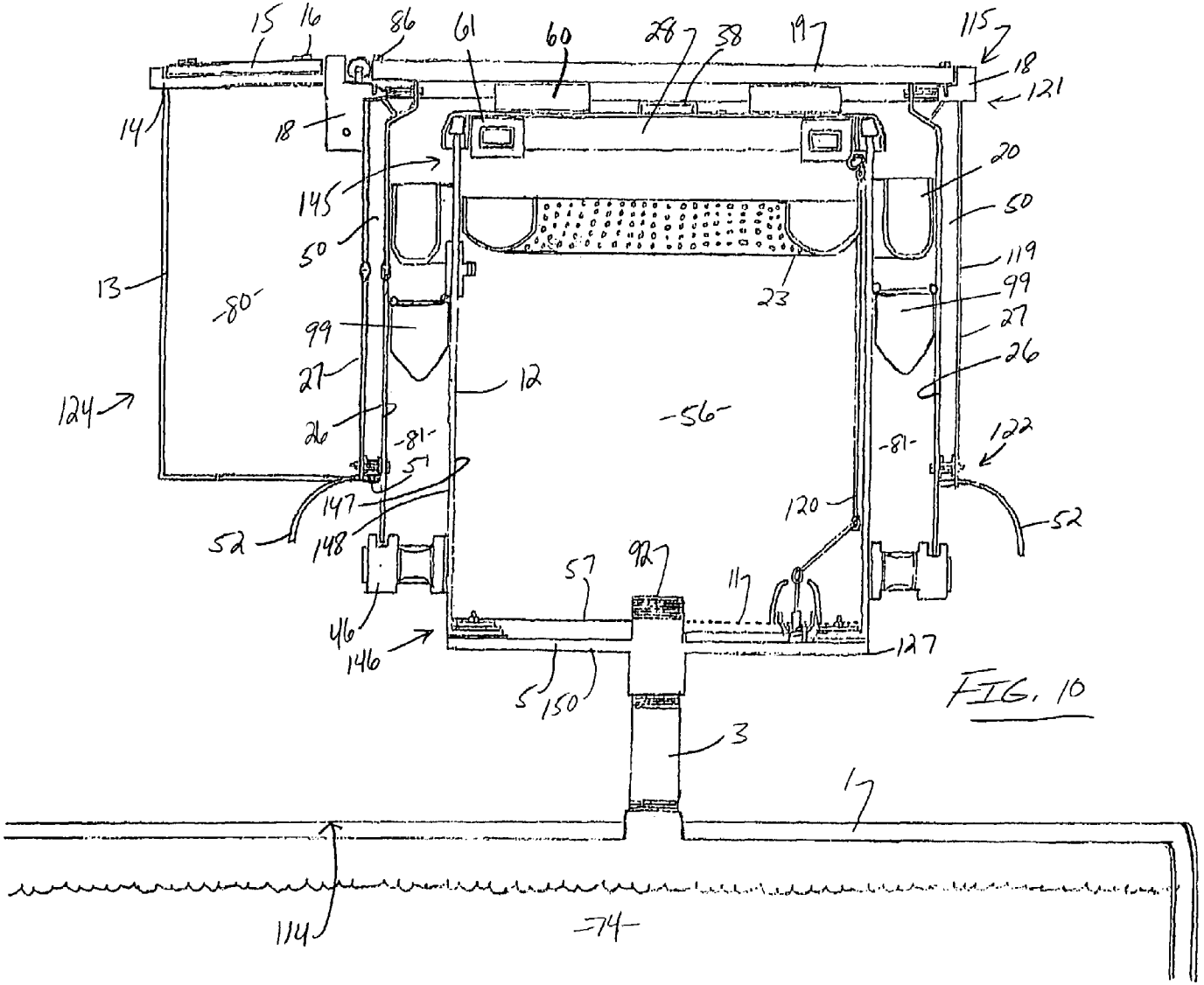
Figure 11:
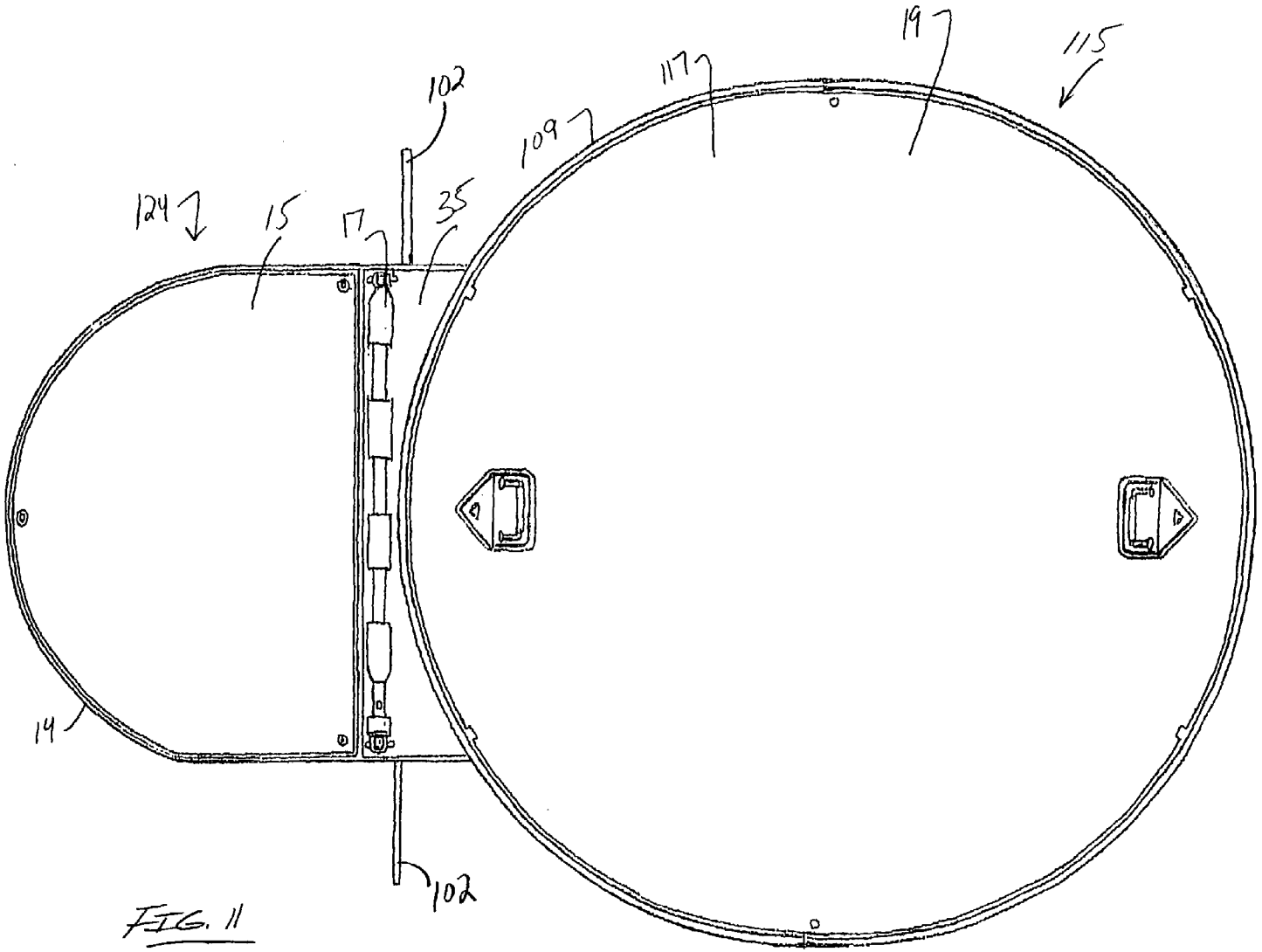
Figure 12:
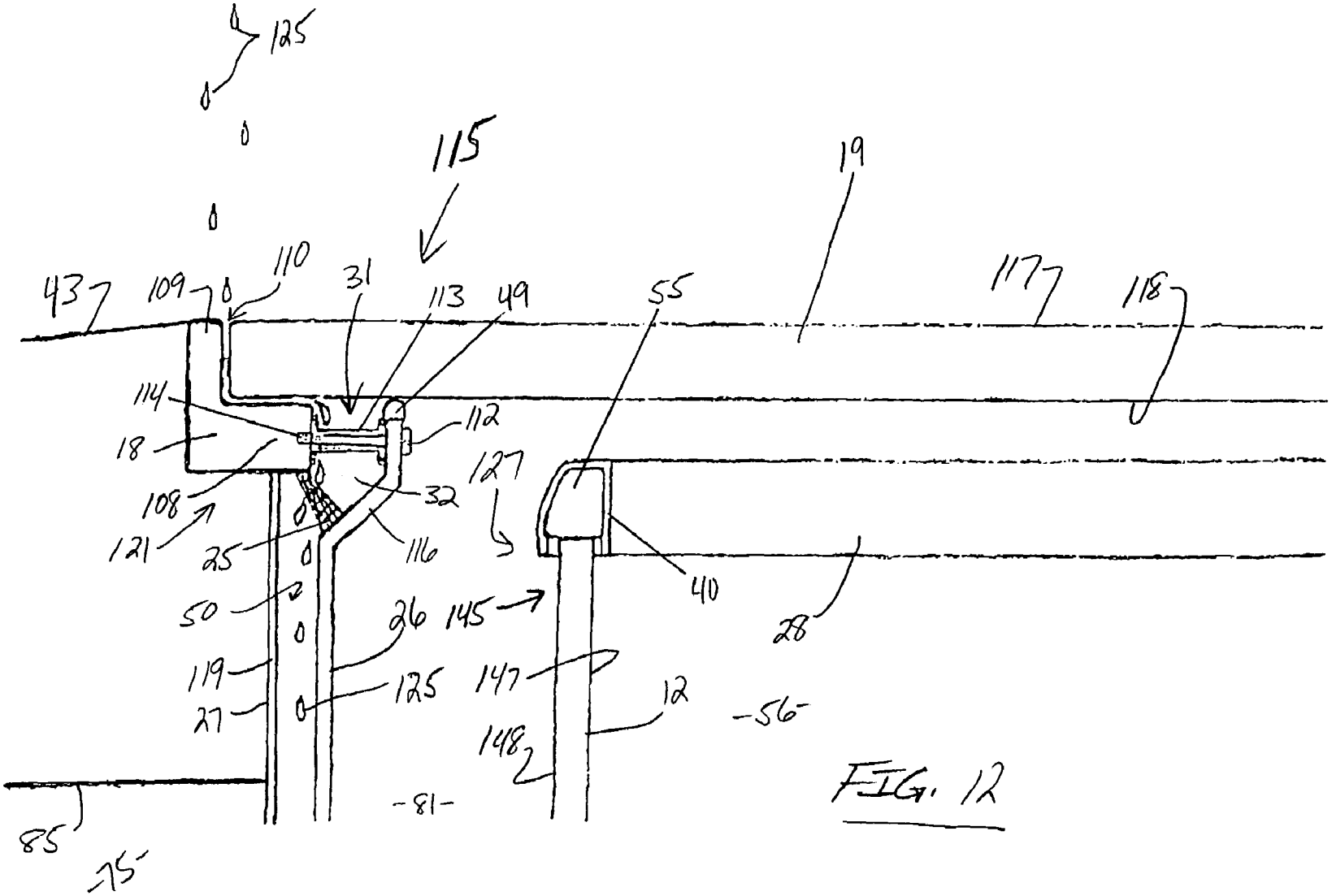
Figure 13:
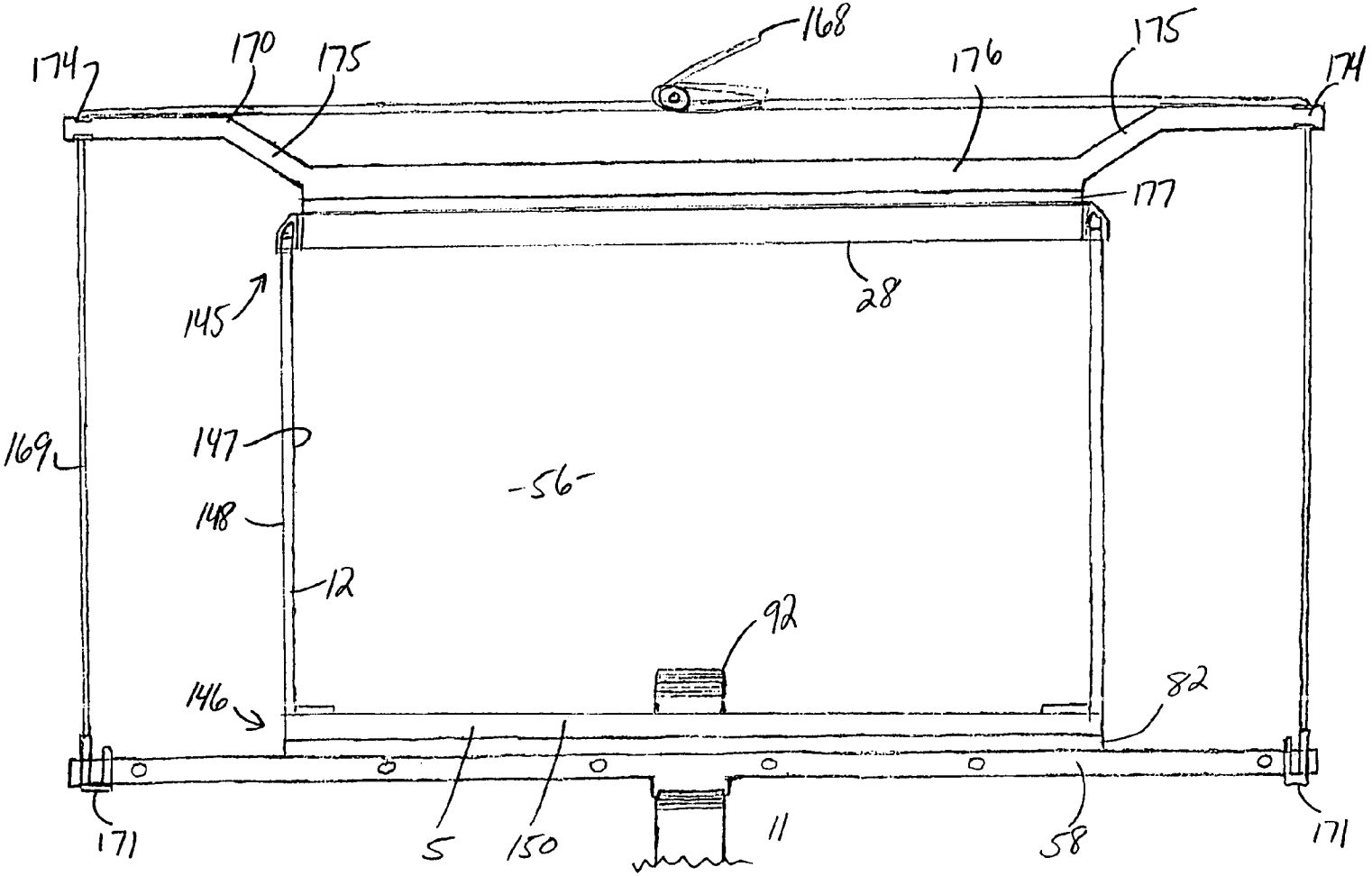
Figure 14:
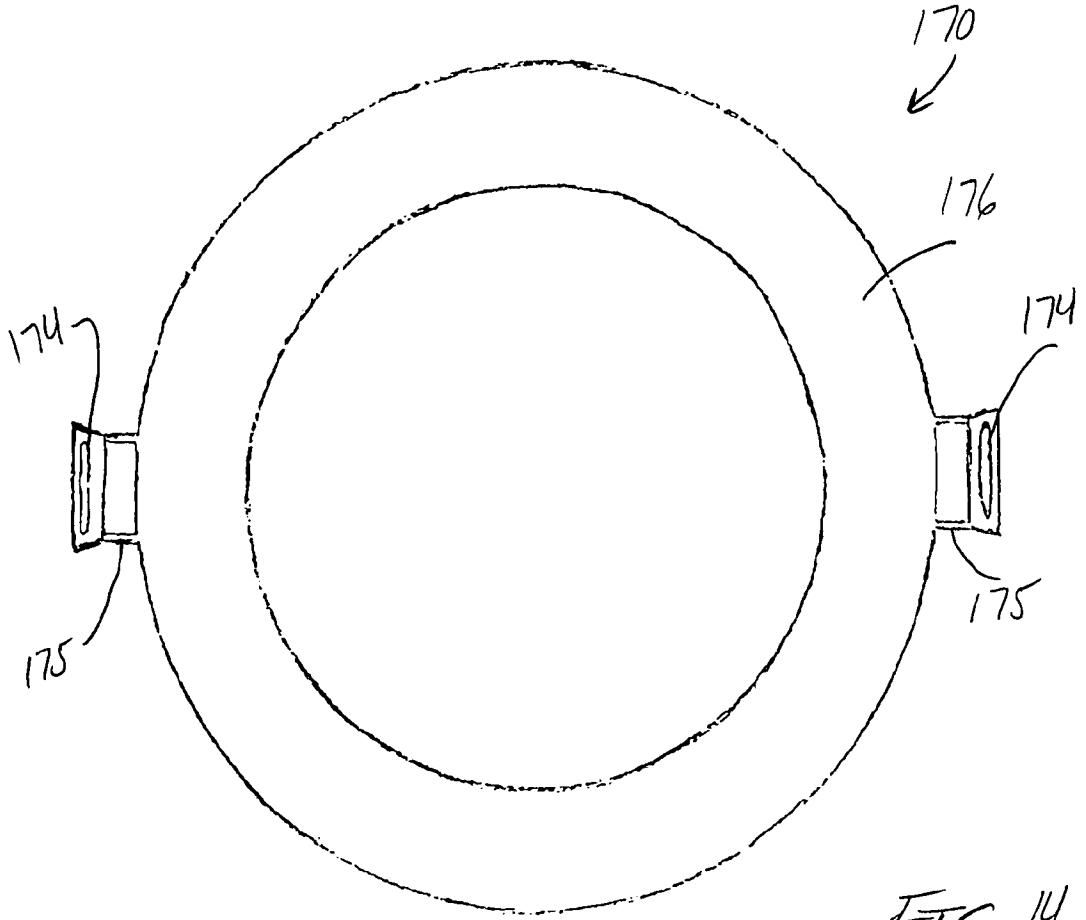
Figure 15:
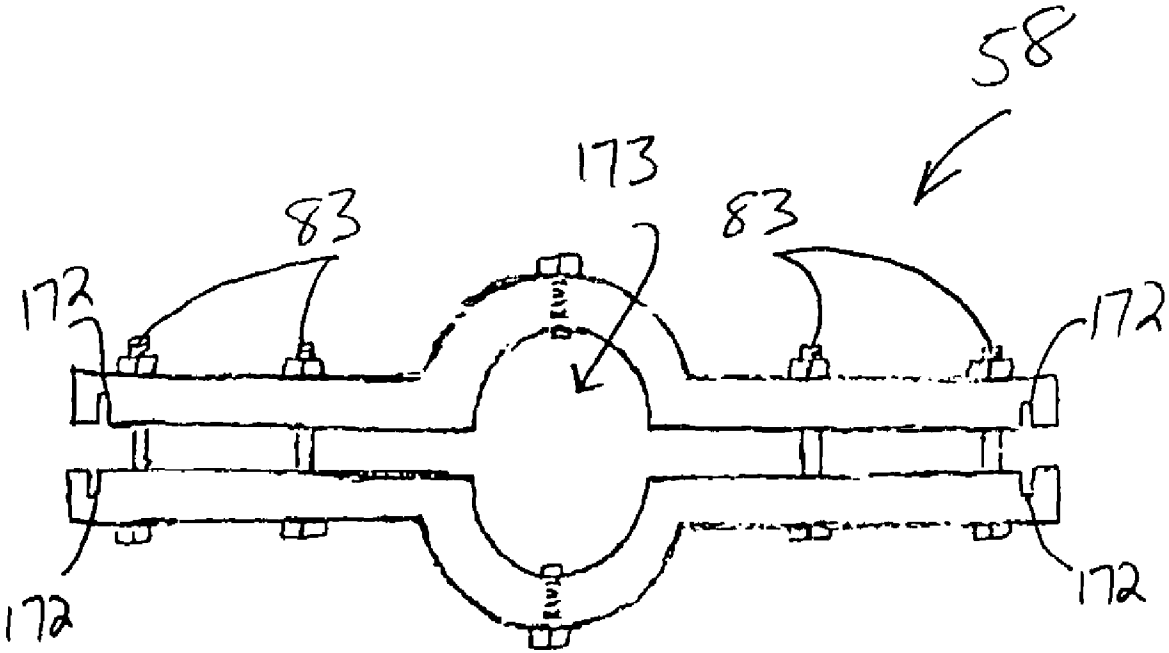
Figure 16:
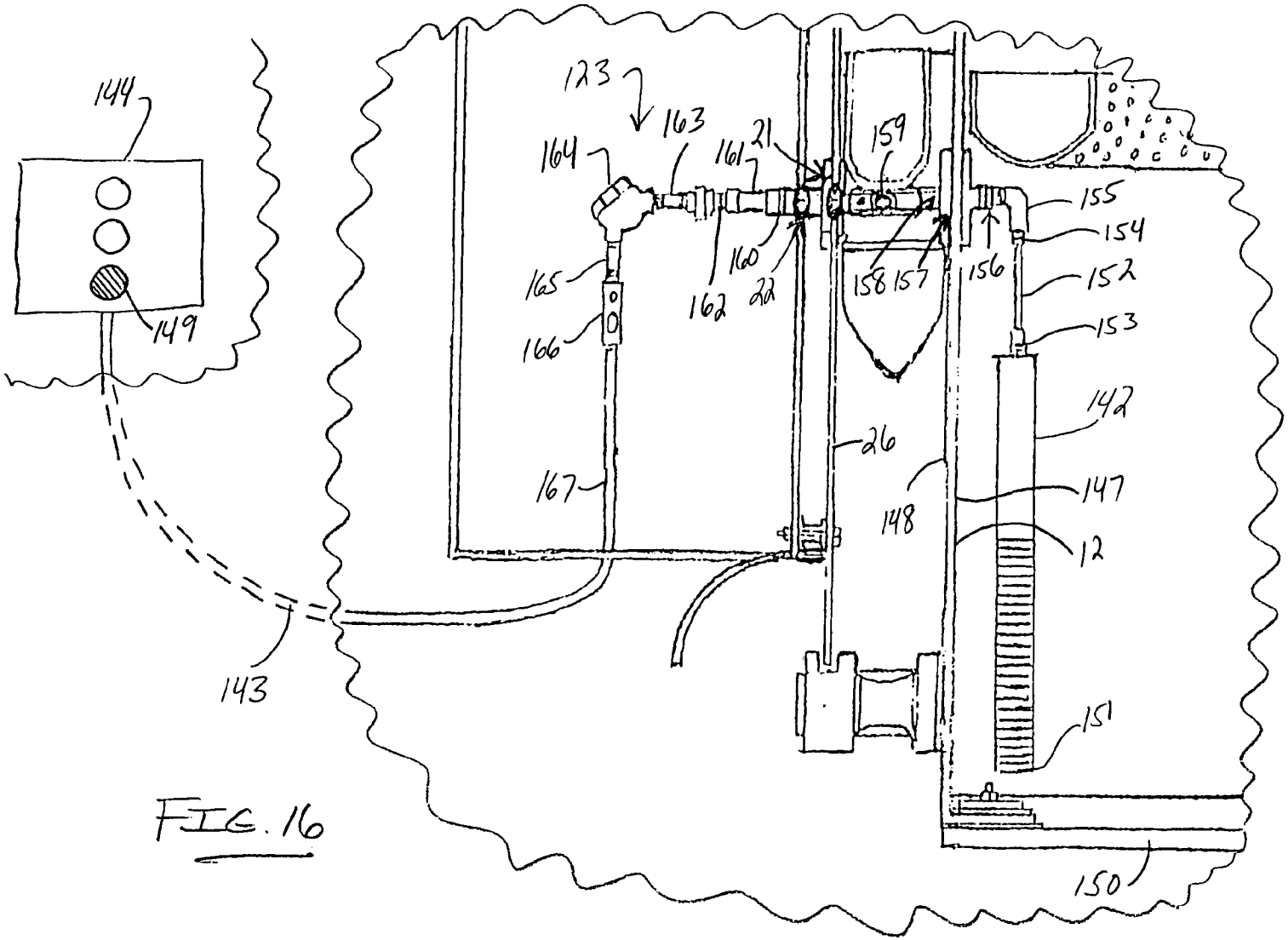
Figure 17:
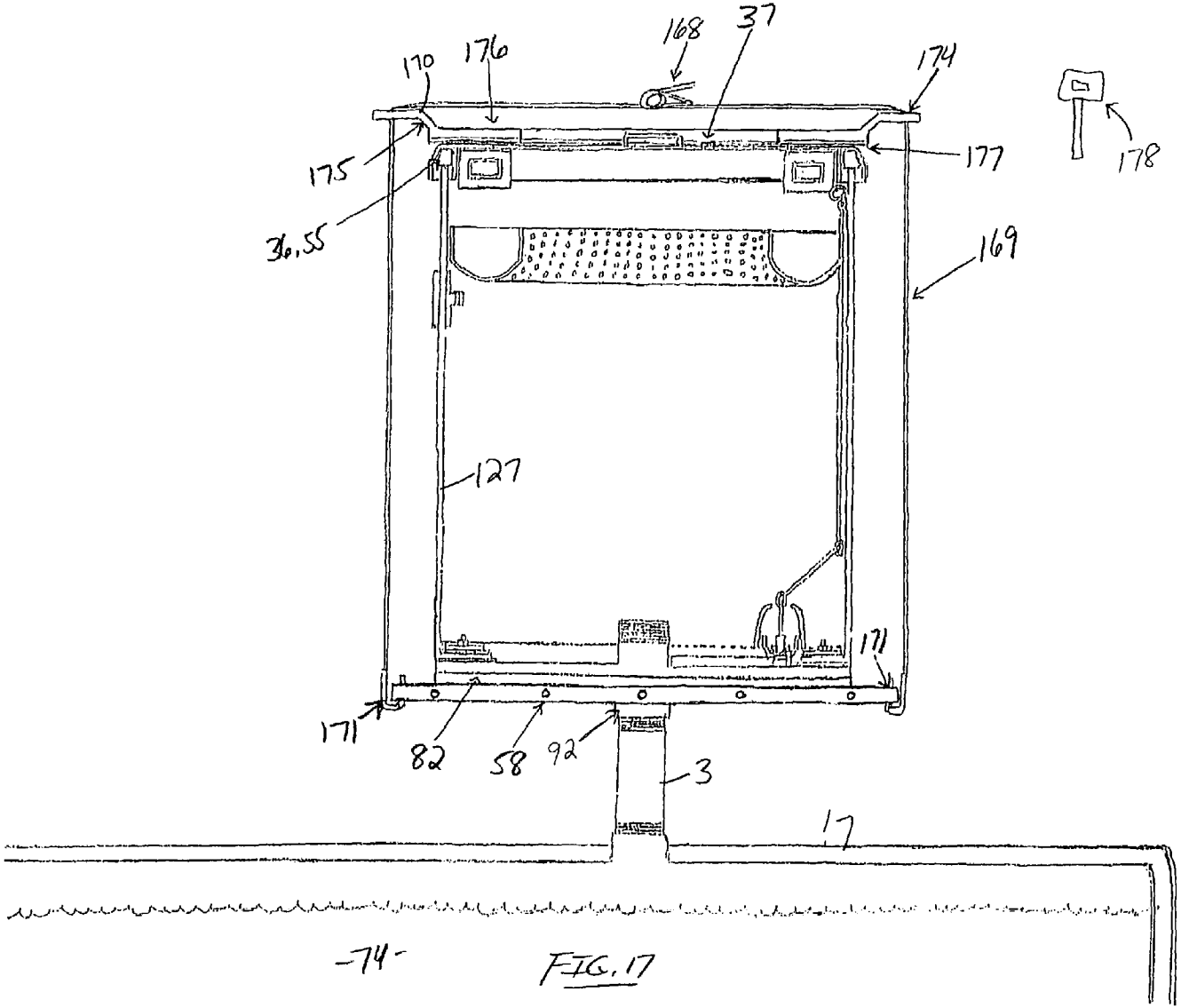

FIG. No. 2 is a fragmentary side view depiction of the secondary spillage containment system shown in FIG. No. 1 in communication with the first underground storage tank assembly as received in a system-receiving cavity with certain parts broken away to show inner, otherwise-hidden structure.

FIG. No. 3 is a fragmentary enlarged side view depiction of an upper left quadrant of the secondary spillage containment system shown in FIG. No. 1.

FIG. No. 4 is a fragmentary enlarged side view depiction of an upper right quadrant of the secondary spillage containment system shown in FIG. No. 1.

FIG. No. 5 is a fragmentary enlarged side view depiction of a lower left quadrant of the secondary spillage containment system shown in FIG. No. 1.

FIG. No. 6 is a fragmentary enlarged side view depiction of a lower right quadrant of the secondary spillage containment system shown in FIG. No. 1.

FIG. No. 7 is a side view depiction of a primary spillage containment assembly of the present invention with certain parts broken away to show inner, otherwise-hidden structure.

FIG. No. 8 is a fragmentary side view depiction of an alternative secondary spillage containment system in communication the primary spillage containment assembly shown in FIG. No. 7 and the first underground storage tank assembly as received in a system-receiving cavity with certain parts broken away to show inner, otherwise-hidden structure.

FIG. No. 9 is a fragmentary side view depiction of an alternative secondary spillage containment system in communication a chamber-monitoring system and the first underground storage tank assembly as received in a system-receiving cavity with certain parts broken away to show inner, otherwise-hidden structure.

FIG. No. 10 is a fragmentary side view depiction of an alternative secondary spillage containment system in communication with a second underground storage tank assembly with certain parts broken away to show inner, otherwise-hidden structure.

FIG. No. 11 is a top plan view of a primary manhole assembly and laterally adjacent secondary manhole assembly with a lid assist rolling device intermediate the primary and secondary manhole assembly.

FIG. No. 12 is a fragmentary enlarged side view depiction of the superior portions of a moisture-directing, outer manhole channel as situated amidst adjacent structure(s).

FIG. No. 13 is a fragmentary side view depiction of an air-test assembly as outfitted upon a secondary spillage containment assembly in communication with a tank access conduit with certain parts broken away to show inner, otherwise-hidden structure.

FIG. No. 14 is a top plan view of a lid-clamping assembly of the air-test assembly shown in FIG. No. 13.

FIG. No. 15 is a top plan view of a strap anchor assembly of the air-test assembly shown in FIG. No. 13.

FIG. No. 16 is a fragmentary enlarged side view depiction of the chamber-monitoring system shown in FIG. No. 9 in assembled relation with a secondary spillage containment system.

FIG. No. 17 is a fragmentary side view depiction of a secondary spillage containment assembly outfitted with the air-test assembly shown in FIG. No. 13 in communication with the second underground storage tank assembly with certain parts broken away to show inner, otherwise-hidden structure.

COMPONENT LISTING

1> Storage tank
2> Female opening on top of the storage tank
3> Tank access conduit
4> Inferior pod conduit opening

5> Secondary basal platform
6> Superior pod conduit opening
7> Inferior lip gasket
8> Base shell lip
9> Superior lip gasket assembly
10> Bolts
11> Epoxy coating fill line
12> Secondary containment wall
13> Secondary manhole skirt
14> Secondary lid support
15> Secondary manhole lid
16> Recessed bolts for lid
17> Lid assist rolling device (primary manhole assembly)
18> Lid-support structure (primary manhole assembly)
19> Manhole lid (primary manhole assembly)
20> Secondary debris tray
21> Flexible wall entry fitting
22> Wall knockout fitting
23> Primary debris tray
24> Flexible conduit entry fitting
25> Screen
26> Inner isolation wall
27> Primary manhole skirt assembly.
28> Containment-accessing lid
29> Inferior drainage outlet
30> Superior drainage inlet
31> Channel bolt assembly
32> Water collection area
33> Drain diverter
34> Nuts
35> Recessed area
36> Lid gasket
37> Air test port
38> Lid handle
39> Gasket-receiving groove
40> Inner diameter ring portion
41> Finished primary grade
42> Secondary grade
43> Surface layer
44> Recessed rest support
45> Removable strapping material
46> Skirt support base wrap
47> Mounting clips
48> Roller assist removable brake pin (primary manhole assembly)
49> Top cap ring (primary manhole assembly)
50> Outer manhole channel (primary manhole assembly)
51> Preferred moisture outlet (primary manhole assembly)
52> Inferior open bottom screen
53> Channel spacing insert
54> Diverter drainage pipe
55> Protective cap
56> Secondary spillage containment chamber
57> Epoxy coating
58> Strap anchor assembly
59> Bolt-down screw holes
60> Spacer inserts
61> Hollow lid rest donut
62> Inferior ring surface
63> Hollowed center
64> Extension clips
65> Bubble screen
66> Pull ring
67> Pull drain device
68> Platform aperture
69> Drain channel
70> Drain cup
71> Pull ring
72> Pull cord guide
73> Flexible pull drain cord
74> Storage tank contents
75> Backfill material
76> Fasten junction of lift handle 38 to containment-accessing lid 28
77> Optional flexible sealant
78> Optional flexible sealant
79> Conduit gateway
80> Utility chamber
81> Inner manhole cavity
82> Anchor gasket
83> Anchor bolts
84> Conduit-engaging gasket
85> Junction between surface layer 43 and backfill material 75
86> Bolt and washer assemblage
87> Bolt-down-receiving aperture
88> Clamp
89> Drainage exit
90> Superior open bottom screen
91> Bolts
92> Pod conduit
93> Mounting bolts
94> Nuts
95> Clamp
96> Pull drain gasket
97> Bolted junction of reinforcement ring 98
98> Reinforcement ring
99> Wedge-shaped flexible ring
100> Superior portion of flexible ring 99
101> Flexible sealant
102> Rebar extension(s)
103> Reinforced base section
104> Strap clamping area
105> Hinged locking lid handle (primary spillage containment assembly)
106> Lid hinge (primary spillage containment assembly)
107> Adaptor fitting (4-inch pipe) (primary spillage containment assembly)
108> Lid-support portion (primary manhole assembly)
109> Lid-centering portion (primary manhole assembly)
110> Extruded bolt assemblies (primary spillage containment assembly)
111> Moisture inlet (primary manhole assembly)
112> Bolt and washer assembly
113> Sleeve support
114> Female tapped opening
115> Primary manhole assembly
116> Diverter portion (of inner isolation wall 26)
117> Superior manhole surface
118> Inferior manhole surface
119> Outer isolation wall
120> Pull drain assembly
121> Superior skirt end
122> Inferior skirt end
123> Sensor assembly
124> Secondary manhole assembly
125> Moisture (channel-directed)
126> Primary spillage containment assembly
127> Secondary spillage containment assembly (spill-pod)
128> Extension conduit
129> Primary basal platform
130> Primary containment wall

131> Conduit-accessing lid
132> Inner wall surface
133> Outer wall surface
134> Superior wall end
135> Inferior wall end
136> Extension conduit axis
137> Platform conduit
138> Wall-support structure
139> Superior conduit end
140> Inferior conduit end
141> Primary spillage containment chamber
142> Sensor
143> Sensor circuitry
144> Conduit-to-tank monitoring system
145> Superior pod end
146> Inferior pod end
147> Inner pod surface
148> Outer pod surface
149> Clear sensor signal
150> Pod-support structure (secondary spillage containment assembly)
151> Sensor bottom
152> Sensor cable
153> Sensor connection
154> Cord grip connector
155> Explosion proof elbow
156> Clamp
157> Flexible pod entry fitting
158> Galvanized cavity pipe nipple
159> Seal-off cavity fitting
160> Clamp
161> Whip hose
162> nion fitting
163> First chamber pipe nipple
164> Capped elbow
165> Second chamber pipe nipple
166> Seal-off chamber fitting
167> Electrical conduit
168> Strap ratchet
169> Strap
170> Lid-clamping assembly
171> Strap end hook
172> Strap hook-receiving structure
173> Conduit-receiving structure
174> Strap guide
175> Offset structure
176> Lid pressure ring
177> Lid pressure gasket
178> Air test gauge

DETAILED DESCRIPTION OF THE PREFERRED EMBODIMENT(S)

Referring now to the drawings, a preferred embodiment of the present invention concerns spillage-containing means for isolating certain matter from adjacent compartments or regions commonly associated with underground storage tanks. The spillage-containing means or matter-isolating means are defined, in part, by a spillage containment system comprising certain spillage containment assemblies and a unique manhole assembly. The present invention thus discloses a spillage containment system for use in combination with an underground storage tank assembly comprising a storage tank 1 as illustrated and referenced in FIG. Nos. 1, 2, 5, 6, 8–10, and 17; a tank access conduit 3 (preferably a 4-inch pipe nipple (cut to length per application)) as illustrated and referenced in FIG. Nos. 1, 2, 5, 6, 8–10, and 17.

From a general consideration of the noted figures and from a particular inspection of FIG. No. 2, it will be seen that tank access conduit 3 preferably comprises male threads at each end thereof. The junction intermediate tank access conduit 3 and storage tank 1 is defined, in part, by an integrally formed, threaded (4-inch) female opening 2 on the top of storage tank 1. It will be understood that tank access conduit 3 enables a user to gain access to storage tank 1 and thus gain access to the storage tank contents 74 in storage tank 1, which storage tank contents may include certain liquid(s) or other stored material. Storage tank contents 74 are generally referenced in FIG. Nos. 1, 2, 9, 10, and 17.

It will be further understood that the typical underground tank assembly as heretofore specified is usually buried, in part, by backfill material 75 such as gravel and/or sand. For purposes of the present invention, it is recommended that ⅛-inch, self-compacting pea gravel be used as backfill material 75, which backfill material (region) 75 is generally referenced in FIG. Nos. 2–6, 8, 9, and 12. The backfill material 75 is most usually covered by a surface layer 43 such as a concrete slab or asphalt paving as generally illustrated and referenced in FIG. Nos. 2, 8, 9, and 12. Typically a concrete pad or slab is poured on top of the underground storage tank system and around the manholes cooperatively associated therewith. It is contemplated that surface layer 43 is preferably graded to otherwise direct matter away from any intermediate structure (such as a manhole lid and/or skirt assembly). The finished primary grade 41 of concrete slab, for example, may preferably have a gradual 3-inch pitch from the top of the manhole area to the substantially horizontal flat grade of the surrounding concrete slab, which finished grade 41 has been generally referenced in FIG. Nos. 2, 8, and 9. The junction or boundary intermediate surface layer 43 and backfill material 75 is further referenced at 85 in FIG. Nos. 2, 8, 9, and 12.

In a preferred embodiment, it is contemplated that the matter-isolation system of the present invention may be thought of as comprising an underground system-receiving cavity 114 as generally referenced in FIG. Nos. 8–10; storage tank 1; tank access conduit 3; certain backfill material 75; and a primary manhole assembly 115 as generally illustrated and referenced in FIG. Nos. 1, and 8–12. From the foregoing, it should be noted that the system-receiving cavity 114 is essentially that void located intermediate displaced earth or backfill material 75 and surface layer 43 for receiving storage tank 1, tank access conduit 3, primary manhole assembly 115, and other structures as the case may be.

The primary manhole assembly 115 of the present invention preferably comprises a primary manhole lid 19 (preferably of a bolt-down gasket type) as illustrated and referenced in FIG. Nos. 1–4, and 8–10; and a primary skirt assembly 27 as illustrated and referenced in FIG. Nos. 1–6, 8–10, and 12. Primary manhole lid 19 may preferably be secured by a bolt and washer assemblage 86 as illustrated and referenced in FIG. Nos. 1, 2, 4, and 8–10. A bolt-down-receiving aperture 87 is preferably formed in the lid seat as a means to enable bolt securement as further referenced in FIG. Nos. 2 and 4. Bolt-down-receiving aperture 87 is preferably a female threaded bolt-receiving hole that is outfitted with a no-seize sealant-coated recessed Allen type bolt, to protect the female threads from debris buildup when not in use or when holding down manhole lid 19 during installation.

Primary manhole lid 19 inherently comprises a superior lid surface 117 as generally referenced in FIG. Nos. 11 and 12; and an inferior lid surface 118 as further referenced in FIG. No. 12. The primary skirt assembly 27 preferably comprises a double-walled, lid-supporting skirt comprising an outer isolation wall 119 as illustrated and referenced in FIG. Nos. 1–6, 8–10, and 12; an inner isolation wall 26 as illustrated and referenced in FIG. Nos. 1–6, 8–10, and 12; a superior skirt end 121 as referenced in FIG. Nos. 1, 3, 4, 8–10, and 12; and an inferior skirt end 122 as referenced in FIG. Nos. 1, 3–6, and 8–10. Outer isolation wall 119 is preferably constructed from materials such as polyethylene, certain steels, composite, cast iron, or fiberglass. Outer isolation wall 119 is a part of drain trough, moisture-directing channel, or gutter system and also functions as an isolation wall for preventing the backfill material 75 from entering areas inwardly adjacent to primary skirt assembly 27.

It will be seen from an inspection of the noted figures that inner isolation wall 26 essentially defines a conduit-surrounding or pod-surrounding inner manhole cavity 81 as further illustrated and referenced in FIG. Nos. 2–6, 8–10, and 12; and a moisture-directing, outer manhole channel 50 as illustrated and referenced in FIG. Nos. 2–6, 8–10, and 12. Outer manhole channel 50 extends intermediate inner isolation wall 26 and outer isolation wall 119, the inner isolation wall 26 being designed to support primary manhole lid 19 at inferior lid surface 118 in superior adjacency to tank access conduit 3. The outer manhole channel 50 is designed to direct moisture 125 from superior lid surface 117 to the backfill material 75 as cooperatively depicted in FIG. Nos. 3, 8, and 12. The outer manhole channel 50 thus functions to isolate the tank access conduit 3 and inner manhole cavity 81 from channel-directed moisture 125. Notably, the inner manhole cavity 81 further allows for movement and/or flexibility of the system should the surface layer 43 or storage tank 1 shift or settle after installation.

The spillage containment system of the present invention preferably comprises, in combination, a primary spillage containment assembly 126 as illustrated and referenced in FIG. Nos. 7 and 8; a secondary spillage containment assembly 127 as illustrated and referenced in FIG. Nos. 1, 3–6, 8–10, 12, 13, and 17; and manhole assembly 115 as previously specified. The primary spillage containment assembly 126 may preferably comprise a (4-inch diameter) pipe nipple or extension conduit 128; a primary basal platform 129; a primary containment wall 130; and a conduit-accessing lid 131 all as further illustrated and referenced in FIG. Nos. 7 and 8. It will be understood from a consideration of the noted figures that the extension conduit 128 inherently comprises a superior extension conduit end 139, an inferior extension conduit end 140 (when in an assembled state) as depicted in FIG. No. 7, as well as a longitudinal extension conduit axis 136 as further referenced in FIG. No. 7. Further, the primary containment wall 130 inherently comprises an inner wall surface 132, an outer wall surface 133, a superior wall end 134, and an inferior wall end 135 as further referenced in FIG. No. 7.

The inner wall surface 132 is preferably installed in substantially concentric relation about the extension conduit 128 or the longitudinal extension conduit axis 136 as generally depicted in FIG. Nos. 7 and 8. The primary basal platform 129 preferably comprises a platform conduit 137 as illustrated and referenced in FIG. Nos. 7 and 8; and wall-support structure 138 as further illustrated and referenced in FIG. Nos. 7 and 8. Platform conduit 137 is essentially a tunnel through primary basal platform 129 at either end of which is an opening. It is contemplated that the openings at either end of platform conduit 137 are preferably threaded female openings for receiving 4-inch diameter (threaded) pipe. It should be understood that the conduit-accessing lid 131 is cooperatively associated with superior wall end 134 of primary containment wall 130 and essentially functions to enable a user to selectively access superior extension conduit end 139 via the superior wall end 134. Conduit-accessing lid 131 preferably comprises a hinged, locking lid handle 105 at the top of containment-accessing lid 131 as further referenced in FIG. Nos. 7 and 8. It will be further specified that conduit-accessing lid 131 preferably comprises a lid hinge 106 and an adaptor fitting (4-inch diameter pipe) as referenced in FIG. Nos. 7 and 8. Together, inner wall surface 132, wall-support structure 138, and conduit-accessing lid 131 cooperatively form a primary spillage containment chamber 141 adjacent extension conduit 128 as further referenced in FIG. Nos. 7 and 8.

Secondary spillage containment assembly 127 as nicknamed Spillage Containment Pod or "Spillpod," for short, preferably comprises a secondary basal platform 5 as illustrated and referenced in FIG. Nos. 1, 2, 4–6, 8–10, and 13; a secondary containment wall 12 as illustrated and referenced in FIG. Nos. 1–6, 8–10, 12, and 13; and a containment-accessing lid 28 all as illustrated and referenced in FIG. Nos. 1–4, 8–10, 12, and 13. The secondary containment wall 12 preferably comprises a superior pod end 145 as illustrated and referenced in FIG. Nos. 1, 3, 4, 8–10, 12, and 13; an inferior pod end 146 as illustrated and referenced in FIG. Nos. 1, 5, 6, 8–10, 12, and 13; an inner pod surface 147 as illustrated and referenced in FIG. Nos. 1, 3–6, 8–10, 12, and 13; and an outer pod surface 148 as illustrated and referenced in FIG. Nos. 1, 3–6, 8–10, 12, and 13.

The secondary basal platform 5 preferably comprises a pod conduit 92 as illustrated and referenced in FIG. Nos. 1–6, 8–10, 13, and 17; and pod-support structure 150 as illustrated and referenced in FIG. Nos. 1, 2, 4–6, 8–10, and 13. The superior surface of pod-support structure 150 is preferably etched as a means to provide better epoxy adhesion. At either end of pod conduit 92 is a conduit opening. As will be understood from a general consideration of FIG. No. 2, the inferior pod conduit opening 4 is preferably a threaded female opening (4-inch diameter pipe) and the superior pod conduit opening 6 is preferably a threaded male opening (4-inch diameter pipe). It is contemplated that inner pod surface 147 is preferably positioned or positionable in substantially concentric relation about extension conduit 128 and/or primary spillage containment assembly 126 as may be seen from a general inspection of FIG. No. 8.

It will be understood from an inspection of the noted figures that the containment-accessing lid 28 comprises a lid handle 38, which lid handle 38 (as illustrated and referenced in FIG. Nos. 1–4, and 8–10) is welded or otherwise fastened 76 (as generically referenced in FIG. No. 2) to containment-accessing lid 28. Containment-accessing lid 28 preferably further comprises a protective cap 55 as referenced in FIG. Nos. 2, 3, and 12, or a lid gasket 36 as referenced in FIG. Nos. 2 and 4; a recessed gasket-receiving groove 39 as referenced in FIG. Nos. 2 and 3; an inner diameter ring portion 40 as referenced in FIG. Nos. 2, 3, and 12; and a lightweight hollow lid rest donut 61 as illustrated and referenced in FIG. Nos. 1–4, and 8–10. Hollow lid rest donut 61 comprises an inferior ring surface 62 (as referenced in FIG. Nos. 2–4) that preferably extends about ½ inch below the inferior terminal portions of containment-accessing lid 28, and a hollowed center 63 as further referenced in FIG. Nos. 2–4.

Hollow lid rest donut 61 is essentially a ring that is adhered to bottom of containment-accessing lid as lid-buffering means or pod-buffering means. In other words, hollow lid rest donut 61 provides energy absorption when containment-accessing lid 28 is removed and set aside. The resulting assemblage thus functions to enable the user to selectively access the primary spillage containment assembly 126 via the superior pod end 145. Containment-accessing lid 28 is preferably constructed from materials such as stainless steel, polyethylene, or fiberglass. Secondary containment wall 12 is preferably constructed from fiberglass, steel, or polyethylene and preferably comprises a diameter that could range from about 18 inches to about 48 inches. Notably, however, when using polyethylene in the construction of secondary containment wall 12, a stainless steel reinforcement ring 98 should be utilized at superior pod end 145 intermediate secondary containment wall 12 and containment-accessing lid 28 as illustrated and referenced in FIG. No. 2. Reinforcement ring 98 is preferably a two-piece bolted reinforcement ring that is optionally used if secondary containment wall 12 is constructed from polyethylene and thus functions to reinforce superior pod end 145. The bolted junction 97 of the two-piece bolted reinforcement ring 98 is further referenced in FIG. No. 2.

It will thus be further noted that inner pod surface 147, pod-support structure 150, and containment-accessing lid 28 together cooperatively form a secondary spillage containment chamber 56 adjacent the primary spillage containment assembly 126 as generally referenced in FIG. Nos. 2–6, 8–10, 12, and 13. It will be further understood from a consideration of FIG. No. 8 that platform conduit 137 communicates extension conduit 128 with pod conduit 92 and pod conduit 92, in turn, communicates platform conduit 137 with tank access conduit 3. The continuous conduit assemblage thus enables access to storage tank 1 or tank access via the primary spillage containment assembly 126 and the secondary spillage containment assemblies 127.

It will be seen from an inspection of FIG. Nos. 1–6, 8–10, and 12 that inner isolation wall 26 extends intermediate the secondary spillage containment assembly 127 and primary manhole lid 19 for supporting primary manhole lid 19 at inferior lid surface 118 in superior adjacency to superior pod end 145. Primary manhole assembly 115 may further preferably comprise a lid-support structure 18 intermediate outer isolation wall 119 and inferior lid surface 118 at superior skirt end 121 as referenced in FIG. Nos. 1–4, 8–10, and 12. Lid-support structure 18 is preferably sized and shaped to seatedly receive primary manhole lid 19. The lid-support structure 18 further preferably comprises a lid-support portion 108 as illustrated and referenced in FIG. No. 3, and a lid-centering portion 109 or lid-centering means as illustrated and referenced in FIG. Nos. 3, 4, 11 and 12.

It will be seen from an inspection of FIG. Nos. 2, 3, and 11 that the present invention contemplates use of a lid-assist roller device 17 comprising roller means for movement and a roller assist removable brake pin 48. It is contemplated that the lid-centering means of the present invention may be defined, in part, by lid-assist roller device 17 as cooperatively associated with brake pin 48. Preferably, a solid steel reinforced base section 103 supports lid-assist roller device 17 as generally referenced in FIG. No. 2. The reinforced base section 103 extends below lid-support structure 18 and preferably comprises a width comparable to the width of a secondary manhole lid 15 (as referenced in FIG. No. 11) and is reinforced with rebar extension(s) 102 on each side for added strength at the roller-assistive, reinforced base section 103 after a concrete pour (as further referenced in FIG. Nos. 2 and 11).

Notably, inner isolation wall 26 is cooperatively associated with lid-support portion 108 for enhancing support of primary manhole lid 19 and for directing diverted moisture 125 through outer manhole channel 50 as cooperatively depicted in FIG. Nos. 3, 8, and 12. In this regard, it is contemplated that inner isolation wall 26 may comprise a diverted portion adjacent superior skirt end 121. It will be seen from an inspection of FIG. Nos. 3 and 4, for example, that the diverted superior portion(s) of inner isolation wall 26 function to maintain a substantially uniform channel width at outer manhole channel 50 adjacent lid-support portion 108. Both lid-support portion 108 and inner isolation wall 26 function to support primary manhole lid 19 at inferior manhole surface 118, and the path for moisture 125 is preferably diverted adjacent the inferior lid surface 118 to provide certain filtering-enablement means.

As previously implied, primary manhole assembly 115 may preferably further comprise a sub-assembly or secondary manhole assembly 124 as generally illustrated and referenced in FIG. Nos. 1–3, and 8–11. Secondary manhole assembly 124 preferably comprises a secondary manhole skirt 13 as illustrated and referenced in FIG. Nos. 1–3, 5, and 8–10; a conduit gateway 79 as referenced in FIG. Nos. 2 and 9; secondary manhole lid 15 (preferably of a bolt-down gasket type) as illustrated and referenced in FIG. Nos. 1–3, and 8–11; and a secondary lid support 14 as illustrated and referenced in FIG. Nos. 1–3, and 8–11. It may be noted from an inspection of FIG. Nos. 1–3, and 8–10 that recessed bolts 16 may be utilized to secure or bolt-down secondary manhole lid 15. Preferably a secondary grade 42 (as referenced in FIG. No. 2) comprising a slightly more pronounced pitch will be cooperatively associated with secondary manhole assembly 124 as a means to ensure redirection of moisture 125 away from secondary manhole assembly 124.

Secondary manhole skirt 13 is preferably integrally formed or otherwise cooperatively associated with outer isolation wall 119. Together, secondary manhole skirt 13, secondary manhole lid 15 and outer isolation wall 119 form or define a utility chamber 80 as referenced in FIG. Nos. 1–3, 5, and 8–10. It will be noted from an inspection of FIG. Nos. 2 and 11 that the junction intermediate primary manhole lid 19 and secondary manhole lid 15 comprises a recessed area 35 for receiving lid-assist rolling device 17. Utility chamber 80 is designed to house or protect or isolate certain conduit, fittings, and wiring connections. Thus, it is contemplated that utility chamber 80 may preferably comprise a circuitry-housing compartment (such as a capped elbow 164 as illustrated in FIG. No. 16) for protecting certain wiring connections. Housing certain chamber-monitoring circuitry, the circuitry-housing compartment enables certain chamber-monitoring means for monitoring at least one select assembly region. The select assembly region may be selected from the group consisting of primary spillage containment chamber 141, secondary spillage containment chamber 56, inner manhole cavity 81, and outer manhole channel 50. The chamber-monitoring means may preferably be defined by a sensor assembly 123 as generally referenced in FIG. Nos. 9 and 16.

For ease of illustration, sensor assembly 123 has only been depicted as monitoring secondary spillage containment chamber 56 in FIG. Nos. 9 and 16, but may also function to monitor any of the noted chambers or regions according to the spirit of the present invention and the following descriptions. Sensor assembly 123 preferably comprises a liquid or vapor sensor 142, sensor circuitry 143, and a conduit-to-tank monitoring system 144. The sensor circuitry 143 electrically communicates sensor 142 with conduit-to-tank monitoring system 144 for detecting (unwanted) matter (such as liquid or vapor) in the select assembly region. In other words, conduit-to-tank monitoring system 144 is the termination point of sensor circuitry 143 and is a machine for notification and alarm should sensor 142 be set off by presence of unwanted materials in the select assembly region.

As depicted in FIG. No. 16, conduit-to-tank monitoring system 144 is visually depicting the color green (as referenced at clear sensor signal 149) for indicating a select assembly region having no contamination. If a spill or water infiltration is detected at the select assembly region, it is contemplated, that in addition to an alarm sensor signal, the tank-to-monitoring system 144 may further comprise certain data-outputting means, such as a printer, for documenting the sensor location, time and date of the alarm signal. It is contemplated that the print out capability (a printed report) of an alarm and problem will greatly help the underground tank owner with documentation and recourse for addressing why the problem occurred.

More particularly, sensor assembly 123 comprises select region-located hardware comprising a liquid or vapor sensor bottom 151 (having field adjustable height and recommended for positioned placement in adjacency to pod-support structure 150); a sensor cable assembly comprising a sensor cable 152, a sensor connection 153, and a cord grip connector 154 (for forming a liquid tight seal on cable after cable is tightened); an explosion proof elbow 155 (90 degree fitting); a clamp 156 for a flexible entry fitting (clamp 156 also forms a liquid tight seal after clamp is tightened); and a flexible conduit entry fitting 24 (cooperatively associated with claim 156). The select region-located hardware is referenced in FIG. Nos. 2 (flexible conduit entry fitting 24) and 16 (sensor 142, sensor bottom 151, sensor cable 152, sensor connection 153, cord grip connector 154, explosion proof elbow 155, and clamp 156).

It will be seen from an inspection of FIG. Nos. 12 and 16 that, extending through secondary containment wall 12, is a flexible pod entry fitting 157 for conduits ½-inch, ¾-inch, and 1-inch in size. It will be understood that a hole is drilled into secondary containment wall 12 and the two piece entry fitting 157 is joined together to form a liquid tight seal. Extending intermediate outer pod surface 148 and inner isolation wall 26 is an aligned nipple assembly comprising a galvanized cavity pipe nipple 158 and fillable explosion proof seal-off cavity fitting 159. After cable 152 is pulled through fitting 159, fitting 159 may preferably be filled with Chico brand hardening sealant compound or similar other compound for forming an impenetrable seal.

From an inspection of FIG. Nos. 2, 12, and 16 it will be understood that an aligned flexible wall entry fitting 21 extends through inner isolation wall 26 for conduits ½-inch, ¾-inch, and 1-inch in size. It will be further understood that a hole is drilled into inner isolation wall 26 and the two piece entry fitting 21 is joined together to form a liquid tight seal. Extending through outer isolation wall 119 is an aligned wall knockout fitting 22 for flexible entry fitting at outer isolation wall 119 for conduits sized ½-inch, ¾-inch, and 1-inch (includes rubber grommet gasket ring insert for outer isolation wall 119). Outer isolation wall 119 is then sealed after installation of the grommet and conduit with Bostic brand sealant or similar other sealant. A clamp 160 may then be affixed to knockout fitting 22 as further referenced in FIG. No. 16.

Utility chamber-located hardware includes a flexible explosion proof whip hose 161 (preferably horse cock, braided flex hose), an explosion proof union fitting 162, a first (galvanized) chamber pipe nipple 163 (male thread at each end), an explosion proof capped elbow 164 (in other words, a circuitry-housing compartment—an explosion proof wiring connection box may also be used), a second (galvanized) chamber pipe nipple 165, an explosion proof fillable seal-off chamber fitting 166, and electrical conduit 167 for protecting and housing sensor circuitry 143. The secondary manhole skirt 13 functions to support secondary manhole lid 15 (openable for access to isolated electrical fittings, and wire connections), which lid 15 enables selective access to the circuitry-housing compartment. Conduit gateway 79 may be defined by an opening at the bottom of secondary manhole skirt 13 of secondary manhole assembly 124 for allowing the passage or entrance of electrical conduit 167 into utility chamber 80.

Turning now to other key features, it is further contemplated that the spillage containment system of the present invention may preferably comprise select debris-filtering means, the select debris filtering means being selected from the group consisting of primary debris-filtering means, secondary debris-filtering means, and channel debris-filtering means. It is thus contemplated that the present system may comprise any combination of debris-filtering means as selected from the noted grouping. The primary debris-filtering means are preferably located intermediate outer wall surface 133 at superior wall end 134 and inner pod surface 147 at superior pod end 145. The primary debris-filtering means may thus be defined by a primary debris tray 23 as illustrated and referenced in FIG. Nos. 1–4 and 8–10. Primary debris tray 23 is essentially a perforated one piece removable debris tray or absorbent sock tray that will preferably rest on or seat adjacent outer wall surface 133. In this regard, it will be noted that the present invention contemplates means for supporting primary debris tray 23, which means may be defined by extruded bolt assemblies 110 cooperatively associated with outer wall surface 133 of primary spillage containment assembly 126 as illustrated and referenced in FIG. Nos. 7 and 8. It is contemplated that the primary debris-filtering means may effectively function to filter pod-located debris (i.e. debris entering secondary spillage containment chamber 56) and to otherwise preventing clogging of secondary spillage containment assembly 127.

The secondary debris-filtering means are preferably located intermediate outer pod surface 148 at superior pod end 145 and inner isolation wall 26 at superior skirt end 121. It is contemplated that the secondary debris-filtering means may be defined by a secondary debris tray 20 as illustrated and referenced in FIG. Nos. 1–4 and 8–10. Secondary debris tray 20 is preferably a multi-piece (4–8 removable pieces) solid debris tray or absorbent sock tray that will preferably rest on or seat adjacent outer pod surface 148. In this regard, it will be noted that the present invention contemplates means for supporting secondary debris tray 20, which means may be defined by mounting clips 47 cooperatively associated with inner isolation wall 26 as illustrated and referenced in FIG. Nos. 2 and 3. It is contemplated that the secondary debris-filtering means may effectively function to filter manhole-located debris (i.e. debris entering inner manhole cavity 81) and to otherwise preventing clogging of inner manhole cavity 81.

The channel debris-filtering means are preferably located intermediate lid-support portion 108 and inner isolation wall 26. The channel debris-filtering means may preferably be defined by a screen 25 as illustrated and referenced in FIG. Nos. 2–4, and 12. It will be seen from a careful inspection of FIG. No. 12 that screen 25 is one element of a moisture-directing assemblage. In this regard, it will be seen that outer manhole channel 50 at superior skirt end 121 comprises a void or moisture inlet 111 adjacent lid-centering portion 109 and primary manhole lid 19 where moisture 125 may enter outer manhole channel 50. Further, it will be seen that inner isolation wall 26 is diverted adjacent lid-support portion 108. At this region, in order to maintain a substantially uniform distance or channel width intermediate inner isolation wall 26 and lid-support portion 108, certain structure-spacing or space-maintaining means are contemplated. In this regard, the structure-spacing means may be defined by a channel bolt assembly 31 (as referenced in FIG. Nos. 2 and 12) comprising a bolt and washer assembly 112 (for holding the inner isolation wall 26 in fixed placement), a sleeve support 113 (for correctly spacing the channel width intermediate lid-support portion 108 and inner isolation wall 26), and a female tapped opening (formed in lid-support portion 108) for receiving the bolt. A moisture collection area 120 is thus formed adjacent the diversion portion 116 of inner isolation wall 26 where moisture 125 will enter and divert to the substantially linear portion of outer manhole channel 50 as generally depicted in FIG. Nos. 2 and 12.

It will be seen from an inspection of FIG. Nos. 3 and 8 that moisture 125 then exits or outlets at a moisture outlet 51 or drain exit 89 into backfill material 75. Moisture outlet 51 is further referenced in FIG. Nos. 1–6 and drain exit 89 is referenced in FIG. No. 2. It will be seen from a comparative inspection of FIG. Nos. 1–6 versus FIG. Nos. 8–10 that moisture outlet 51 may comprise an optional bolt on drain diverter 33 (as seen in FIG. Nos. 1–6). Drain diverter 33 can be installed at any section of the outer isolation wall 119 and may be of adjustable length for diverting moisture 125 into backfill material 75. Drain diverter 33 may further comprise an optional diverter drainage pipe 54 (as referenced in FIG. No. 2) and optional diverter drainage pipe connections for piping from connections to pipe to drainage system or to oil/water separator tank system. Other structure that may be optionally outfitted upon primary manhole assembly 115 are certain inferior open bottom screens 52 as illustrated and referenced in FIG. Nos. 1–6, and 8–10; certain superior open bottom screens 90 as illustrated and referenced in FIG. Nos. 1–6; and channel spacing inserts 53 as illustrated and referenced in FIG. Nos. 1–6.

Clamps 88 may function to secure inferior open bottom screens 52 to the optional drain diverter 33 and clamps 95 may function to secure superior open bottom screens 90 to drain exit 89 as referenced in FIG. No. 2. Optional open bottom screens 52 and 90 function to prevent backfill material 75 and/or surrounding material(s) from entering outer manhole channel 50. Optional channel spacing inserts 53 are connected to inner isolation wall 26 and function to correct spacing between the outer isolation wall 119 and inner isolation wall 26. Bolts 91 may function to secure channel spacing inserts 53 within outer manhole channel 50. Bolts 91 extend through inferior skirt end 122 and channel spacing inserts 53 to secure channel spacing inserts 53 in place as referenced in FIG. Nos. 2–6. The channel debris-filtering means may thus be defined by the foregoing specifications and are designed to both filter channel-located debris (i.e. debris entering or passing through outer manhole channel 50) and prevent clogging of outer manhole channel 50.

It will be seen from a further inspection of FIG. No. 12, that certain structure is located intermediate inner isolation wall 26 and inferior lid surface 118. In this regard, it is contemplated that the present system may comprise select fluid-sealing means, the select fluid-sealing means being selected from the group consisting of lid-sealing means and cavity-sealing means. The lid-sealing means may preferably be defined by an inner isolation wall top cap ring 49 (which top cap ring 49 may comprise a U-shaped transverse cross-section receivable at the superior terminus of inner isolation wall 26) that functions both as a water or moisture barrier or gasket and also protects the superior terminus of inner isolation wall 26 from damage from primary manhole lid 19. It is contemplated that the lid-sealing means function to prevent moisture 125 or other fluid from passing intermediate primary manhole lid 19 and inner isolation wall 26 thus furthering the matter-isolating properties of the present system. Preferably top cap ring 49 is constructed from rubber and will sit 1/16-inch above the skirt lid rest.

Cavity-sealing means may be further incorporated into the system as a means to prevent moisture 125 or other fluid from passing through inner manhole cavity 81 in inferior adjacency to the secondary debris-filtering means or secondary debris tray 20. The cavity-sealing means may preferably be defined by a wedge-shaped flexible ring 99 or donut as illustrated and referenced in FIG. Nos. 1–6, and 8–10. Flexible ring 99 is preferably constructed from tight-fitting, compressible, moisture-impermeable materials and is spatially located intermediate outer pod surface 148 and inner isolation wall 26 for preventing moisture 125 or other matter from passing through inner manhole cavity 81 as earlier noted. The superior ring portion 100 of flexible ring 99 may thus be forcefully pressed between outer pod surface 148 and inner isolation wall 26 in inferior adjacency to secondary debris tray 20 (i.e. before placement of secondary debris tray 20) for forming a tight, yet flexible-fitting, matter-isolating barrier.

Noting that flexible ring 99 is preferably constructed from tight-fitting, compressible, moisture-impermeable materials, it is further contemplated that flexible ring may be formed from an inflatable, air-impermeable casing or alternatively, a material capable of being filled with an injectionable medium. It is noted that underground storage tanks rarely maintain a strict horizontal or vertical posture; for example, settling often occurs leading to misaligned tank installation (s). A flexible ring that is fillable (such as an inflatable ring or a ring fillable with an injectionable medium) may thus function to buffer adjacent structures when the spacing is not uniform intermediate the adjacent structures. It is further contemplated that if flexible ring 99 is constructed from an inflatable casing that inert gas, such as nitrogen, be used to inflate the ring. Further, if flexible ring 99 is to be constructed from a material capable of encasing an injectionable medium, it is contemplated that flame-retardant gel or similar other liquid be used as the medium.

Thus, the installation technician can selectively inflate or fill (or deflate or empty) flexible ring 99 given structural need at the installation site. In this regard, it will thus be noted that the secondary spillage containment chamber 56 will necessarily comprise a longitudinal chamber axis and the outer manhole channel 81 will necessarily a longitudinal channel axis. Under perfectly aligned conditions, the structural relationship between the two axes will be collinear or substantially collinear. However, should settling occur or similar other misalignment (such as improper initial installation), the chamber and channel axes may not be collinear and thus, may either intersect, or more commonly orient in a non-intersecting relation. It will thus be understood that the chamber and channel axes will have a select relation to one another, the select relation being selected from the group consisting of a collinear relation, an intersecting relation, and a non-intersecting relation. The assembly-buffering means (for example, flexible ring 99) may thus further function to fill the (otherwise non-uniform) spacing intermediate adjacent structure(s).

Certain other fluid-sealing means cooperatively associated with peripheral components of the present system may include flexible sealant (Bostic or like sealant) as referenced at 77 in FIG. No. 2 for sealing the region intermediate secondary debris tray and inner isolation wall 26. Similarly the present system may include flexible sealant such as Bostic brand sealant for sealing the region intermediate secondary debris tray 20 and outer pod surface 148 as referenced at 78 in FIG. No. 2. Further, flexible sealant as referenced at 101 in FIG. No. 2 may be utilized for sealing the region(s) intermediate flexible ring 99 and outer pod surface 148 and/or inner isolation wall 26.

It is further contemplated that flexible ring 99 may further function to provide certain assembly-buffering means or secondary pod-buffering means. In other words, should certain forces be inwardly directed against primary skirt assembly 27, flexible ring 99 may function to buffer secondary spillage containment assembly 127 from the forceful contact. Additionally, however, certain primary pod-buffering means may function to provide buffering protection to secondary containment wall 12. In this regard, it is contemplated that the primary pod-buffering means may be defined by a skirt support base wrap 46 as illustrated and referenced in FIG. Nos. 1–6, and 8–10.

Skirt support base wrap 46 is preferably constructed from an impact-absorbing material and functions to provide buffering protection for secondary containment wall 12 during shipping and will allow for systemic movement should settling or movement of storage tank 1 or surface layer 43 occur. It is contemplated that skirt support base wrap 46 may preferably be adhesively attached to outer pod surface 148 via state of the art adhesives. It will be seen from an inspection of skirt support base wrap 46 that a recessed rest support 44 may preferably be formed in skirt support base wrap 46 for receiving the inferior terminus of inner isolation wall 26 as illustrated and referenced in FIG. Nos. 2–6. Further, an inferior drainage outlet 29 and a superior drainage inlet 30 may be formed in skirt support base wrap 46 as illustrated and referenced in FIG. Nos. 1–6. Preferably, inferior drainage outlet 29 and superior drainage inlet 30 are defined by female openings that can be plugged at the election of the installation technician. Notably, inferior drainage outlet 30 can be used for a drainage connection to flexible drain piping.

Secondary spillage containment assembly 127 may thus be said to preferably comprise select pod-buffering means, the select pod-buffering means being selected from the group consisting of wall-buffering means (for example, flexible ring 99) and end-buffering means (for example, skirt support base wrap 46). It will thus be noted that the wall-buffering means may be defined by the previously specified cavity-sealing means. The wall-buffering means are defined, in part, by being preferably constructed from a flexible, fluid-impermeable material for preventing moisture 125 or other fluid from passing through inner manhole cavity 81 and for protecting secondary spillage containment assembly 127 from forceful contact. The end-buffering means are defined, in part, by being cooperatively associated with inferior pod end 146 and inferior skirt end 122 for protecting secondary spillage containment assembly 127 from forceful contact (from, for example, settling backfill material 75).

As preliminarily suggested, the spillage containment system of the present invention may further comprise select matter-outletting means, the select matter-outletting means being selected from the group consisting of manhole-outletting means and pod-outletting means. It is contemplated that the manhole-outletting means may preferably be cooperatively associated with the pod-buffering means for enabling the user to outlet matter from inner manhole cavity 81. The manhole-outletting means may thus be preferably defined by inferior drainage outlet 29 and/or superior drainage inlet 30. Alternatively, the manhole-outletting means may be defined by the secondary debris-filtering means and/or flexible ring 99 (for example, if the material utilized in the construction of flexible ring 99 is flexed so as to interrupt otherwise continuous, fluid-impermeable contact between flexible ring 99 and either outer pod surface 148 or inner isolation wall 26).

The pod-outletting means may preferably be cooperatively associated with secondary basal platform 5 for enabling the user to selectively outlet matter from secondary spillage containment chamber 56. The pod-outletting means may preferably be defined by a pull drain assembly 120 as generally illustrated and referenced in FIG. Nos. 1, and 8–10, which pull drain assembly 120 is anchored to pod-support structure 150 by cooperative mounting bolts 93 and nuts 94 as generally referenced in FIG. No. 2. Pull drain assembly 120 preferably comprises extension clips 64 as referenced in FIG. Nos. 2, and 4–6; a bubble screen 65 as illustrated and referenced in FIG. Nos. 2, and 4–6, a pull ring 66 as illustrated and referenced in FIG. Nos. 2, and 4–6; a pull drain device 67 as illustrated and referenced in FIG. Nos. 2, and 4–6; a platform aperture 68 as illustrated and referenced in FIG. Nos. 2–6; a drain channel 69 as illustrated and referenced in FIG. Nos. 2–6; a drain cup 70 as referenced in FIG. Nos. 2, and 4–6; a pull ring 71 as illustrated and referenced in FIG. Nos. 2 and 4; a pull cord guide 72 as illustrated and referenced in FIG. Nos. 2, 4, and 6; a flexible pull drain cord 73 as illustrated and referenced in FIG. Nos. 2, and 4–6; and a pull drain gasket 96 as referenced in FIG. Nos. 2, and 4–6.

Extension clips 64 are utilized to hold the bottom portions of bubble screen 65 in place at the pull drain location. Bubble screen 65 essentially functions to prevent pod-located debris from entering the pull drain location. Pull ring 66 enables a user to manually pull flexible pull drain cord 73 which cord extends intermediate pull ring 66 and pull drain device 67. Pull drain device 67 is essentially a reseatable valve that, when actuated, opens a drain allowing liquid to flow through drain channel 69 formed in secondary basal platform 5 and enter pod conduit 92 via platform aperture 68, whereafter the fluid may be directed into storage tank 1 via tank access conduit 3. It is contemplated that pull drain device 67 may be removable and pluggable at the election of the installation technician. Notably, pull cord guide 72 is affixed to inner pod surface 147 and pull drain cord 73 extends therethrough.

Drain cup 70 is essentially a recessed area or cup formed in drain channel 69 that functions to prevent entrance of epoxy into drain channel 69 during epoxy application. In this regard, it will be noted that pourable, self-leveling epoxy is preferably applied atop secondary basal platform 5 (the surface of which is preferably etched for better epoxy adhesion) to create a one-piece, leak-free, solid, bottom surface that is smooth, easily accessible and easy to clean. An epoxy coating fill line 10 is preferably formed on inner pod surface 147 as a means to aid the installation technician in applying a proper amount of epoxy as illustrated and referenced in FIG. Nos. 1, 2, 4–6, and 8–10. The epoxy coating 57 is further referenced in FIG. Nos. 1–6, and 8–10. In this regard, it should be noted that the matter-isolating system of the present invention thus contemplates certain pod-sealing means, which pod-sealing means function to sealing the secondary containment chamber 56 at pod-support structure 150. The pod-sealing means may thus be defined by comprising a pourable, self-leveling epoxy coating, applicable to pod-support structure 150 for forming a liquid impermeable, smooth inner pod surface in superior adjacency to pod-support structure 150. Notably, an epoxy coating is an existing product commonly used for coating the interior of fiberglass and steel tanks. By utilizing an epoxy coating at the bottom of the Spillpod or secondary containment chamber 56, the coating will function to strengthen and tie the various components together for forming a liquid tight, easily cleanable, smooth surface.

It will be further seen from an inspection of FIG. Nos. 2–6 that secondary containment wall 12 preferably comprises a base shell lip 8 at the inferior end thereof, which base shell lip 8 is attachable to secondary basal platform 5 at pod-support structure 150.

In inferior adjacency to base shell lip 8 is certain inferior lip gasket 7, which is predrilled and formed to fit the base of the base shell lip 8. In superior adjacency to base shell lip 8 a superior lip gasket assembly 9 is installed. Superior lip gasket assembly 9 preferably comprises a mounting ring and gasket, which gasket is pre drilled and formed to fit atop base shell lip 8. Bolts 10 and cooperative nuts 34 function to fasten base shell lip 8 and thus secondary containment wall 12 to pod-support structure 150. Inferior lip gasket 7, superior lip gasket assembly 9, bolts 10, and nuts 34 are referenced in FIG. Nos. 2–6.

The spillage containment system of the present invention may further comprise certain air-testing means for enabling the user to selectively access and test air sealed within secondary spillage containment chamber 56. The air-testing means may preferably be defined by an air test assembly comprising a strap assembly (comprising a strap ratchet 168, a strap 169, and strap hook ends 171 as illustrated and referenced in FIG. Nos. 13 and 17); a lid-clamping assembly 170 as illustrated and referenced in FIG. Nos. 13, 14, and 17; and a strap anchor assembly 58 as illustrated and referenced in FIG. Nos. 2, 13, 15, and 17. Strap anchor assembly 58 is essentially a two-piece bolt on air-test strapping clamp support that mounts to the 4-inch female opening of pod conduit 92 after installation and tightening of secondary spillage containment assembly 127. Strap anchor assembly 58 comprises strap hook-receiving structure 172 (as referenced in FIG. No. 15), which structure 172 functions to receive strap hook ends 171 as generally depicted in FIG. No. 13. Strap hook-receiving structure 172 or strap clamping area 104 (referenced in FIG. No. 2) thus functions to effect clamping retention of lid-clamping assembly 170 as operatively engaged by strap ratchet 168.

More particularly, it will be specified that strap anchor assembly 58 has conduit-receiving structure 173 and fastener-receiving structure for receiving anchor bolts 83 as illustrated and referenced in FIG. Nos. 2 and 15. It is contemplated that conduit-receiving structure 173 is preferably outfitted with conduit-engaging gasket 84 as referenced in FIG. No. 2. Further, it is contemplated that an anchor gasket 82 be situated intermediate pod-support structure 150 and strap anchor assembly 58 as referenced in FIG. Nos. 2, 13, and 17. Lid-clamping assembly 170 preferably comprises strap guides 174; certain offset structure 175; and a lid pressure ring 176 all as further illustrated and referenced in FIG. Nos. 13, 14, and 17. Preferably a lid pressure gasket 177 is situated intermediate lid pressure ring 176 and containment-accessing lid 28 as illustrated and referenced in FIG. Nos. 13 and 17.

It will thus be seen that strap anchor assembly 58 is installable adjacent tank access conduit 3 and comprises strap-anchoring means (i.e. strap hook-receiving structure 172). Lid-clamping assembly 170 is installable adjacent containment-accessing lid 28 and comprises strap-guiding means (i.e. strap guides 174). The strap assembly is cooperatively associated with the strap-anchoring means and lid-clamping assembly 170 and comprises strap length-adjusting means (i.e. strap ratchet 168), the strap length-adjusting means being operable for clamping lid-clamping assembly 170 against containment-accessing lid 28 for sealing air within secondary spillage containment chamber 56. It will be recalled that protective cap 55 or lid gasket 36 may preferably be situated intermediate containment-accessing lid 28 and secondary containment wall 12 so as to provide for a more robust air tight seal during the air-test clamping procedure here specified.

An air test port 37 (i.e. air test-enabling means) is further illustrated and referenced in FIG. Nos. 13 and 17. It is contemplated that air test port 37 may preferably be defined by a ¼-inch air test port with recessed Allen screw type plug used as an air-vacuum test port that is welded, or otherwise fastened onto the top of containment-accessing lid 28. The air test kit may further preferably comprise an air test gauge or instrument 178 cooperatively associated with the air test-enabling means for testing air otherwise sealed in secondary spillage containment chamber 56 as further referenced in FIG. No. 17.

During installation of secondary spillage containment assembly 127, certain removable items may assist the installation technician in properly spacing certain structure. The spillage containment system of the present invention thus contemplates removable structure-spacing means and certain removable strapping material. The removable structure-spacing means are designed for spacing primary manhole assembly 115 relative to secondary spillage containment assembly 127 during installation of surface layer 43.

As earlier specified, surface layer 43 is gradable adjacent primary manhole lid 19. The removable structure-spacing means may then be removed after surface layer 43 is finally graded (the spacing thus being set). The removable structure-spacing means may preferably be defined by spacer inserts 60 as illustrated and referenced in FIG. Nos. 1–4, and 8–10. Spacer inserts 60 function to hold primary manhole assembly 115 at the correct height during the installation of the concrete and are removed and disposed of after the concrete slab has been poured, and the concrete is set. Certain predrilled and threaded bolt-down screw holes 59 with recessed Allen screw plugs may be used to bolt-down primary manhole lid 19 when using spacer inserts 60 as referenced in FIG. No. 2.

The removable strapping material 45 (as referenced in FIG. No. 45) may be removed after backfill material 75 is placed and functions to properly support skirt support base wrap 46. Notably, certain structure such as flexible ring 99, may further define structure-spacing means as contemplated by the present system. In other words, flexible ring 99 may be used during installation for alignment spacing between secondary spillage containment assembly 127 and inner isolation wall 26 and may further be removed after installation if drainage between secondary spillage containment assembly 127 and inner isolation wall 26 is desired.

While the foregoing specifications contain much specificity, this specificity should not be construed as limitations on the scope of the invention, but rather as an exemplification of the invention. For example, as is implicit in the foregoing descriptions the present disclosure may further be said to disclose a certain kit for outfitting underground storage tanks as a means to isolate various interactive elements from one another. In this regard, it is contemplated that the kit may comprise any of the specified components for use in isolating certain underground storage tank-related matter from certain other underground storage tank-related matter. In this regard, it is further contemplated that while reference has periodically been made to liquids as stored underground, certain systems require that vapor also be kept isolated from adjacent structure. Thus, the system of the present invention is thought to further apply to vapor-separative systems and the like.

The spirit of the present invention thus contemplates a spillage containment kit for outfitting an underground tank assembly having a storage tank, a tank access conduit, and a primary spillage containment assembly. The spillage containment kit may comprise a secondary spillage containment assembly having a basal platform, a containment wall, and a containment-accessing lid. The containment wall may inherently comprise a superior wall or pod end, an inferior wall or pod end, an inner wall or pod surface, and an outer wall or pod surface, whereby the inner pod surface is positionable in substantially concentric relation about the primary spillage containment assembly. The basal platform may comprise a pod conduit and certain pod-support structure and the containment-accessing lid being cooperatively associated with the superior pod end for enabling the user to selectively access the primary spillage containment assembly via the superior pod end. The inner pod surface, the pod support structure, and the containment-accessing lid may thus form a secondary spillage containment chamber adjacent the primary spillage containment assembly.

The spillage containment kit may further comprise a primary manhole assembly (and perhaps a secondary manhole assembly) as herein specified; select debris-filtering means; and select (fluid) sealing means. The select sealing means may be installable as selected from the group consisting of manhole-sealing means and pod-sealing means, the manhole-sealing means for preventing matter from passing intermediate the manhole lid and the inferior pod end (i.e. flexible ring 99 and/or secondary debris tray 20) and the pod-sealing means for preventing matter from passing intermediate the inner manhole chamber and the secondary spillage containment chamber (i.e. containment-accessing lid 28 and any gaskets associated therewith). The kit may further comprise assembly-buffering means cooperatively installable adjacent the secondary spillage containment assembly for protecting the secondary spillage containment assembly from forceful contact.

The matter-isolation system of the present invention may preferably be used in combination with an underground tank assembly, wherein the matter-isolation system comprises a first spillage containment assembly (for example, secondary spillage containment assembly 127). The first spillage containment assembly may form a first spillage containment chamber and comprise a first basal platform, a containment wall, and first conduit-accessing means (for example, pod conduit 92) in cooperative communication with the tank access conduit. The matter-isolation system may further comprise a second spillage containment assembly (for example, primary spillage containment assembly 126) for forming a second spillage containment chamber (for example, the primary spillage containment chamber).

The matter-isolation system may comprise certain assembly-buffering means for protecting the secondary spillage containment assembly from forceful contact as cooperatively associated with at least one select matter-isolating structure, the select matter-isolating structure being selected from the group consisting of the secondary spillage containment chamber and the outer manhole channel. The matter-isolation system may further comprise certain pod-sealing means for preventing matter from passing into the secondary spillage containment chamber. Notably, the matter-isolation assembly may be used in combination with a manhole, the matter-isolation assembly comprising a lid and a double-walled, lid-supporting skirt assembly wherein the manhole is spatially located for enabling access to spillage-containing means (for example, primary or secondary spillage containment assemblies 126 or 127, respectively), the spillage-containing means being cooperatively associated with an underground tank assembly.

The so-called Spillpod (SP) kit has been designed to virtually eliminate installation error. In this regard, certain installation methodology is disclosed whereby the installation technician may first determine the distance between the underground storage tank and finished concrete grade (top of concrete). The installer will next add 3 inches to the measurement made between grade and tank top (the specified 3 inches will be the pitch away from the manhole top to the standard grade of the rest of the concrete slab). The installer would then subtract the height of the SP kit. This measurement would be the riser pipe (pipe nipple) length that the installer would provide (riser pipe, usually 4-inch galvanized steel pipe).

The pipe threads would then be coated with a sealant (GASOLOILA brand thread sealant or the like). The pipe would then be tightened into the underground storage tank top orifice/opening chosen for the fill port location with a pipe wrench. The next step would be to coat the top threads of the riser pipe with said sealant. The Pod/secondary containment device used for encapsulating the primary overspill containment assembly would then be installed by setting the device onto said pipe by 2 installers and tightening at the base of the said SP using a pipe wrench. The next step would be to install the outside of the circle manholes, with double wall water drainage trough system (consisting of the primary manhole with skirting, the add manhole with skirting, and the isolation riser with liquid catch and connections).

The next step would be lining up certain alignment guide graphics as incorporated onto the SP and isolation riser portion of the manhole system. The next step would be to install the bottom of the primary manhole skirting into the recessed area on the outside of the flexible alignment skirt support pod base wrap that will be adhered to the base of the pod riser on the outer shell. The communication wiring would be pulled through a conduit from the TMS console to the secondary manhole assembly. An electrical seal-off fitting (eliminates liquids/vapors from traveling through conduit back to the building) would be installed below the connection box and fittings and exiting/outside of the SP. Inside of the SP a cord grip fitting that would hold the cable/wiring going to the sensor and also form a liquid tight seal. The sensor would then be installed into the SP and the wiring connections with the wiring from the TMS to the sensor would be tied together/connected at the connection box.

Upon completion of testing of the sensor the seal off fittings would be filled with recommended CHICO brand compound. All of the electrical fittings will be of the explosion proof type and the use of a flexible braided explosion proof flex hose is recommended to be installed between the 2 seal off fittings. The sensor wiring is low voltage communication wire. If an air test or vacuum test is required the fill pipe and drain port of the OS would be plugged and a gauge would be installed at the ¼-inch opening at the top of the lid of the SP. The lid of the SP would then be secured using the optional vacuum/air test lid hold down assembly. The vacuum or air test would then be applied per requirements. The SP can also be tested using a hydrostatic type test (filling the SP pod with water and visually inspecting the outside wall for leakage). The SP devices should be tested upon completion of manufacturing at the factory and should include test results (passed test/date of test inspector #/name).

The final step would be to bolt-down the electrical connection lid of the manhole and install the primary manhole lid for selective SP access. By having the SP designed for easy installation it eliminates the potential for installation errors. It will be recalled that the wiring connection(s) at the secondary manhole assembly will have "knock out holes" aligned with the entry fitting of the isolation riser and the SP. The alignment spacers and the wedge/ring alignment and sealer would then be installed. The next step would be the installation of the primary spillage containment assembly (which may be preexisting). By lining up certain alignment graphic decal guidelines, which may be incorporated into the system and/or kit, and following the easy to understand instructions, every SP system installation will be the same and virtually eliminate the possibility of contractor installation error.

Thus, although the invention has been described by reference to a preferred embodiment, it is not intended that the novel system or kit be limited thereby, but that modifications thereof are intended to be included as falling within the broad scope and spirit of the foregoing disclosure, the following claims and the appended drawings.

I claim:

1. A spillage containment system for use in combination with an underground tank assembly, the underground tank assembly comprising a storage tank and a tank access conduit, the tank access conduit enabling access to the storage tank, the spillage containment system comprising, in combination:

a primary spillage containment assembly, the primary spillage containment assembly comprising an extension conduit, a primary basal platform, a primary containment wall, and a conduit-accessing lid, the primary containment wall comprising an inner wall surface, an outer wall surface, a superior wall end, and an inferior wall end, the primary basal platform comprising a platform conduit and wall-support structure, the extension conduit being in communication with the platform conduit, the inner wall surface being substantially concentric about the extension conduit, the conduit-accessing lid being cooperatively associated with the primary containment wall for enabling a user to selectively access the extension conduit via the superior wall end, the inner wall surface, the wall-support structure and the conduit-accessing lid forming a primary spillage containment chamber adjacent the extension conduit;

a secondary spillage containment assembly, the secondary spillage containment assembly comprising a secondary basal platform, a secondary containment wall, and a containment-accessing lid, the secondary containment wall comprising an inner pod surface, an outer pod surface, a superior pod end, and an inferior pod end, the secondary basal platform comprising a pod conduit and pod-support structure, the inner pod surface being substantially concentric about the extension conduit, the containment-accessing lid being cooperatively associated with the secondary containment wall for enabling the user to selectively access the primary spillage containment assembly via the superior pod end, the inner pod surface, the pod-support structure and the containment-accessing lid thus forming a secondary spillage containment chamber adjacent the primary spillage containment assembly, the platform conduit communicating the extension conduit with the pod conduit, the pod conduit communicating the platform conduit with the tank access conduit thus enabling tank access via the primary and secondary spillage containment assemblies; and a primary manhole assembly, the primary manhole assembly comprising a manhole lid and a skirt assembly, the manhole lid comprising a superior lid surface and an inferior lid surface, the skirt assembly comprising a double-walled, lid-supporting skirt, the lid-supporting skirt comprising an inner isolation wall, an outer isolation wall, a superior skirt end, and an inferior skirt end, the inner isolation wall defining a pod-surrounding, inner manhole cavity and a moisture-directing, outer manhole channel, the outer manhole channel extending intermediate the inner isolation wall and the outer isolation wall, the inner isolation wall extending intermediate the secondary spillage containment assembly and the manhole lid for supporting the manhole lid at the inferior lid surface in superior adjacency to the superior pod end, the outer manhole channel directing moisture from the superior lid surface to the inferior skirt end thus isolating the secondary spillage containment assembly from channel-directed moisture.

2. The spillage containment system of claim 1 wherein the manhole assembly comprises lid-support structure intermediate the inner isolation wall and the inferior lid surface at the superior skirt end, the lid-support structure being sized and shaped to seatedly receive the manhole lid, the lid-support structure comprising a lid-support portion and a lid-centering portion, the inner isolation wall being cooperatively associated with the lid-support portion for enhancing support of the manhole lid and for directing diverted moisture through the outer manhole channel.

3. The spillage containment system of claim 2 comprising select debris-filtering means, the select debris-filtering means being selected from the group consisting of primary debris-filtering means, secondary debris-filtering means, and channel debris-filtering means.

4. The spillage containment system of claim 3 wherein the primary debris-filtering means are spatially located intermediate the outer wall surface at the superior wall end and the inner pod surface at the superior pod end, the primary debris-filtering means for filtering pod-located debris and for preventing clogging of the secondary spillage containment assembly, the secondary debris-filtering means being spatially located intermediate the outer pod surface at the superior pod end and the inner isolation wall at the superior skirt end, the secondary debris-filtering means for filtering manhole-located debris and for preventing clogging of the inner manhole cavity, the channel debris-filtering means being spatially located intermediate the lid support portion and the inner isolation wall, the channel debris-filtering means for filtering channel-located debris and for preventing clogging of the outer manhole channel.

5. The spillage containment system of claim 4 comprising select fluid-sealing means, the select fluid-sealing means being selected from the group consisting of lid-sealing means and cavity-sealing means, the lid-sealing means for preventing fluid from passing intermediate the manhole lid and the inner isolation wall, the cavity-sealing means for preventing fluid from passing through the inner manhole cavity in inferior adjacency to the secondary debris-filtering means.

6. The spillage containment system of claim 1 wherein the secondary spillage containment assembly comprises select pod-buffering means, the select pod-buffering means being selected from the group consisting of wall-buffering means and end-buffering means, the wall-buffering means being defined by the cavity-sealing means, the wall-buffering means being constructed from a flexible, fluid-impermeable material for preventing fluid from passing through the inner manhole cavity and for protecting the secondary spillage containment assembly from forceful contact, the end-buffering means being cooperatively associated with the inferior pod end and the inferior skirt end for protecting the secondary spillage containment assembly from forceful contact.

7. The spillage containment system of claim 6 comprising select matter-outletting means, the select matter-outletting means being selected from the group consisting of manhole-outletting means and pod-outletting means, the manhole-outletting means being cooperatively associated with the select pod-buffering means for enabling the user to outlet matter from the inner manhole cavity, the pod-outletting means being cooperatively associated with the secondary basal platform for enabling the user to outlet matter from the secondary spillage containment chamber.

8. The spillage containment system of claim 1 comprising a secondary manhole assembly, the secondary manhole assembly being spatially located laterally adjacent the primary manhole assembly, the secondary manhole assembly comprising a utility chamber, the utility chamber comprising a circuitry-housing compartment.

9. The spillage containment system of claim 8 wherein the circuitry-housing compartment enables chamber-monitoring means, the chamber-monitoring means for monitoring at least one select assembly region, the select assembly region being selected from the group consisting of the primary spillage containment chamber, the secondary spillage containment chamber, the inner manhole cavity, and the outer manhole channel.

10. The spillage containment system of claim 1 comprising air-testing means, the air-testing means for enabling the user to selectively access and test air in the secondary spillage containment assembly.

11. The spillage containment system of claim 6 comprising backfill material, a surface layer, and removable structure-spacing means, the backfill material for filling space adjacent the storage tank, the tank access conduit, the secondary spillage containment assembly, the manhole assembly and the surface layer, the select pod-buffering means for protecting the secondary spillage containment assembly from forceful contact with the backfill material, the removable structure-spacing means for spacing the primary manhole assembly relative to the secondary spillage containment assembly during installation of the surface layer, the surface layer being gradable adjacent the manhole lid, the removable structure-spacing means being removed after the surface layer is finally graded, the outer manhole channel directing channel-directed moisture into the backfill material.

12. A spillage containment kit for outfitting an underground tank assembly, the underground tank assembly comprising a storage tank, a tank access conduit, and a primary spillage containment assembly, the tank access conduit enabling access to the storage tank via the primary spillage containment assembly, the spillage containment kit comprising a secondary spillage containment assembly, the secondary spillage containment assembly comprising a basal platform, a containment wall, and a containment-accessing lid, the containment wall comprising a superior pod end, an inferior pod end, an inner pod surface, and an outer pod surface, the basal platform comprising a pod conduit and pod-support structure, the inner pod surface being positionable in substantially concentric relation about the primary spillage containment assembly, the containment-accessing lid being cooperatively associated with the superior pod end for enabling the user to selectively access the primary spillage containment assembly via the superior pod end, the inner pod surface, the pod-support structure, and the containment-accessing lid for forming a secondary spillage containment chamber adjacent the primary spillage containment assembly, the pod conduit for communicating the primary spillage containment assembly with the tank access conduit to enable tank access via the primary and secondary spillage containment assemblies.

13. The spillage containment kit of claim 12 comprising a primary manhole assembly, the primary manhole assembly comprising a primary manhole lid and a primary skirt assembly, the primary manhole lid comprising a superior lid surface and an inferior lid surface, the primary skirt assembly comprising a double-walled, lid-supporting skirt, the lid-supporting skirt comprising an inner isolation wall, an outer isolation wall, a superior skirt end, and an inferior skirt end, the inner isolation wall defining an inner manhole cavity and an outer manhole channel, the inner isolation wall for pod-surrounding installation intermediate the secondary spillage containment assembly and the primary manhole lid and for supporting the primary manhole lid at the inferior lid surface in superior adjacency to the superior pod end, the outer manhole channel extending intermediate the inner isolation wall and the outer isolation wall for directing moisture from the superior lid surface to the inferior skirt end and for isolating the outer pod surface from channel-directed moisture.

14. The spillage containment kit of claim 13 wherein the primary manhole assembly comprises lid-support structure for installation intermediate the outer isolation wall and the inferior lid surface at the superior skirt end, the lid-support structure being sized and shaped to seatedly receive the primary manhole lid, the lid-support structure comprising a lid-support portion and a lid-centering portion, the lid-support portion being installable adjacently opposite the inner isolation wall, the inner isolation wall being cooperatively associated with the lid-support portion for enhancing support of the primary manhole lid and for directing moisture through the outer manhole channel.

15. The spillage containment kit of claim 14 comprising select debris-filtering means, the select debris filtering means being selected from the group consisting of primary debris-filtering means, secondary debris-filtering means, and channel debris-filtering means.

16. The spillage containment system of claim 15 wherein the primary debris-filtering means are installable intermediate the outer wall surface and the inner pod surface for preventing debris from passing into the secondary spillage containment chamber, the secondary debris-filtering means being installable intermediate the outer pod surface and the inner isolation wall for preventing debris from passing through the inner manhole cavity, and the channel debris-filtering means being installable intermediate the lid-support portion and the inner isolation wall for preventing debris from passing through the outer manhole channel.

17. The spillage containment system of claim 16 comprising select sealing means, the select sealing means being installable as selected from the group consisting of manhole-sealing means and pod-sealing means, the manhole-sealing means for preventing matter from passing intermediate the primary manhole lid and the inferior pod end, the pod-sealing means for preventing matter from passing intermediate the inner manhole cavity and the secondary spillage containment chamber.

18. The spillage containment kit of claim 12 comprising assembly-buffering means, the assembly-buffering means being cooperatively installable adjacent the secondary spillage containment assembly for protecting the secondary spillage containment assembly from forceful contact.

19. The spillage containment kit of claim 13 wherein the secondary spillage containment assembly comprises selectively operable pod-draining means and the primary manhole assembly comprises selectively operable manhole-draining means, the manhole-draining means for enabling the user to selectively drain matter from the primary manhole assembly, the pod-draining means for enabling the user to selectively drain matter from the secondary spillage containment chamber.

20. The spillage containment kit of claim 13 comprising an installable secondary manhole assembly, the secondary manhole assembly comprising a secondary manhole skirt, a conduit gateway, and a secondary manhole lid, the secondary manhole skirt being attachable to the outer isolation wall, the secondary manhole skirt, the secondary manhole lid and the outer isolation wall defining a utility chamber, the utility chamber comprising a circuitry-housing compartment.

21. The spillage containment kit of claim 20 comprising a chamber-monitoring kit, the chamber-monitoring kit being installable upon the underground tank assembly for monitoring at least one select assembly, the select assembly being selected from the group consisting of the primary spillage containment assembly, the secondary spillage containment assembly, the primary manhole assembly, and the secondary manhole assembly.

22. The spillage containment kit of claim 12 comprising an air-testing kit, the air-testing kit comprising a strap assembly, a lid-clamping assembly, and a strap anchor assembly, the strap anchor assembly being installable adjacent the tank access conduit and comprising strap-anchoring means, the lid-clamping assembly being installable adjacent the containment-accessing lid and comprising strap-guiding means, the strap assembly being cooperatively associated with the strap-anchoring means and the lid-clamping assembly and comprising strap length-adjusting means, the strap length-adjusting means being operable for clamping the lid-clamping assembly against the containment-accessing lid for sealing air within the secondary spillage containment chamber.

23. The spillage containment kit of claim 22 comprising an air test gauge and air test-enabling means, the air test gauge being cooperatively associated with the air test-enabling means for testing the air sealed in the secondary spillage containment chamber.

24. The spillage containment kit of claim 13 comprising structure-spacing means, the structure-spacing means for enabling the user to properly space select structure during installation, the select structure being selected from the group consisting of the secondary spillage containment assembly and the primary manhole assembly, the structure-spacing means being removable after installation of the select structure.

25. A matter-isolation system for use in combination with an underground tank assembly, the underground tank assembly comprising a storage tank and a tank access conduit, the tank access conduit enabling access to the storage tank via the matter-isolation system, the matter-isolation system comprising a first spillage containment assembly, the first spillage containment assembly comprising a first basal platform, a first containment wall, and first conduit-accessing means, the first containment wall comprising a superior pod end, an inferior pod end, an inner pod surface, and an outer pod surface, the first basal platform comprising first conduit-engaging means and pod-support structure, the first conduit-engaging means being in cooperative communication with the tank access conduit, the inner pod surface being positioned in substantially concentric relation about the tank access conduit, the first conduit-accessing means and the first conduit-engaging means for enabling the user to selectively access the tank access conduit via the superior pod end, the inner pod surface, the pod-support structure, and the first conduit-accessing means forming a first spillage containment chamber adjacent the tank access conduit.

26. The matter-isolation system of claim 25 comprising pod-sealing means, the pod-sealing means for sealing the first spillage containment chamber.

27. The matter-isolation system of claim 26 wherein the pod-sealing means comprise a pourable, self-leveling epoxy coating, the epoxy coating being applicable to the pod-support structure for forming a liquid impermeable, smooth inferior pod surface in superior adjacency to the pod-support structure.

28. The matter-isolation system of claim 25 comprising a second spillage containment assembly, the second spillage containment assembly comprising a second basal platform, a second containment wall, and second conduit-accessing means, the second containment wall comprising a superior wall end, an inferior wall end, an inner wall surface, and an outer wall surface, the second basal platform comprising second conduit-engaging means and wall-support structure, the first and second conduit-engaging means being in cooperative communication with the tank access conduit, the inner wall surface being positioned in substantially concentric relation about the tank access conduit, the first and second conduit-accessing means enabling the user to selectively access the tank access conduit via the superior wall end and the superior pod end, the inner wall surface, the wall-support structure, and the second conduit-accessing means forming a primary spillage containment chamber adjacent the tank access conduit, the first spillage containment chamber thus becoming a secondary spillage containment chamber.

29. The matter-isolation system of claim 28 comprising assembly-buffering means, the assembly-buffering means being cooperatively associated with the secondary spillage containment chamber for protecting the secondary spillage containment chamber from forceful contact.

30. The matter-isolation system of claim 28 comprising select debris-filtering means, the select debris filtering means being selected from the group consisting of primary debris-filtering means and secondary debris-filtering means, the primary debris-filtering means being spatially located intermediate the outer wall surface and the inner pod surface for preventing debris from passing into the secondary spillage containment chamber, the secondary debris-filtering means being located adjacent the outer pod surface for preventing debris from passing the first spillage containment assembly.

31. An underground tank matter-isolation system, the underground tank matter-isolation system comprising an underground system-receiving cavity, an underground storage tank, a tank access conduit, backfill material, and a manhole assembly, the system-receiving cavity being spatially located intermediate the backfill material and a superior surface layer, the storage tank, the tank access conduit, and the manhole assembly being received in the system-receiving cavity, the manhole assembly comprising a manhole lid and skirt assembly, the manhole lid comprising a superior lid surface and an inferior lid surface, the skirt assembly comprising a double-walled, lid-supporting skirt, the lid-supporting skirt comprising an outer isolation wall, an inner isolation wall, and a superior skirt end, the inner isolation wall defining a conduit-surrounding, inner manhole cavity and a moisture-directing, outer manhole channel, the outer manhole channel extending intermediate the inner isolation wall and the outer isolation wall, the inner isolation wall for supporting the manhole lid at the inferior lid surface in superior adjacency to the tank access conduit, the outer manhole channel for directing moisture from the superior lid surface to the backfill material, the outer manhole channel thus isolating the tank access conduit from channel-directed moisture.

32. The underground tank matter-isolation system of claim 31 comprising debris-filtering means, the debris-filtering means being located intermediate the inner and outer isolation walls for preventing debris from passing through the outer manhole channel.

33. The underground tank matter-isolation system of claim 32 comprising moisture-sealing means, the moisture-sealing means being cooperatively associated with the inner isolation wall at the superior skirt end for preventing moisture from passing intermediate the outer manhole channel and the inner manhole channel.

34. The underground tank matter-isolation system of claim 31 comprising removable structure-spacing means for spacing the manhole assembly relative to the tank access conduit during installation of the superior surface layer, the superior surface layer being graded adjacent the manhole lid, the removable structure-spacing means being removed after the superior surface layer is finally graded.

35. A matter-isolation assembly for use in combination with a manhole, the matter-isolation assembly comprising a lid and a double-walled, lid-supporting skirt, the lid-supporting skirt comprising an outer isolation wall, an inner isolation wall, a superior skirt end, and an inferior skirt end, the inner isolation wall defining an inner manhole cavity and an outer manhole channel, the outer manhole channel extending intermediate the inner isolation wall and the outer isolation wall, the inner isolation wall for supporting the manhole lid at the inferior lid surface in superior adjacency to the manhole, the outer manhole channel for directing moisture from the superior lid surface to the inferior skirt end and for isolating the inner manhole cavity from channel-directed moisture.

36. The matter-isolation assembly of claim 35 wherein the manhole is spatially located for enabling access to spillage-containing means, the spillage-containing means being cooperatively associated with an underground tank assembly.

37. The matter-isolation assembly of claim 36 wherein the spillage-containing means are defined by at least one select spillage containment chamber, the select spillage containment chamber being selected from the group consisting of a primary spillage containment chamber and a secondary spillage containment chamber, the underground tank assembly comprising a storage tank and a tank access conduit, the tank access conduit for enabling access to the storage tank, the primary spillage containment chamber for containing spillage adjacent the tank access conduit, the secondary spillage containment chamber for containing spillage adjacent a select structure, the select structure being selected from the group consisting of the tank access conduit and the primary spillage containment chamber.

38. The matter-isolation assembly of claim 37 comprising assembly-buffering means, the assembly-buffering means being cooperatively associated with at least one select matter-isolating structure, the select matter-isolating structure being selected from the group consisting of the secondary spillage containment chamber and the outer manhole channel, the assembly-buffering means for protecting the select matter-isolating structure from forceful contact.

39. The matter-isolation assembly of claim 38 wherein the secondary spillage containment chamber comprises a longitudinal chamber axis and the outer manhole channel comprises a longitudinal channel axis, the chamber and channel axes having a select relation to one another, the select relation being selected from the group consisting of a collinear relation, an intersecting relation, and a non-intersecting relation, the assembly-buffering means for filling space intermediate adjacent structure.

40. The matter-isolation assembly of claim 35 comprising debris-filtering means, the debris-filtering means being located intermediate the inner and outer isolation walls for preventing debris from passing through the outer manhole channel.

41. The matter-isolation assembly of claim 40 comprising moisture-sealing means, the moisture-sealing means being cooperatively associated with the inner isolation wall at the superior skirt end for preventing moisture from passing intermediate the outer manhole channel and the inner manhole channel.

* * * * *